US006387250B1

(12) United States Patent
Henkin et al.

(10) Patent No.: US 6,387,250 B1
(45) **Date of Patent: *May 14, 2002**

(54) WATER SUCTION POWERED AUTOMATIC SWIMMING POOL CLEANING SYSTEM

(76) Inventors: Melvyn L. Henkin, 1001 Sharon La.; Jordan M. Laby, 1389 Beachmont, both of Ventura, CA (US) 93001

( * ) Notice: Subject to any disclaimer, the term of this patent is extended or adjusted under 35 U.S.C. 154(b) by 0 days.

This patent is subject to a terminal disclaimer.

(21) Appl. No.: 09/582,448

(22) PCT Filed: Dec. 23, 1998

(86) PCT No.: PCT/US98/27622

§ 371 Date: Jun. 26, 2000

§ 102(e) Date: Jun. 26, 2000

(87) PCT Pub. No.: WO99/34077

PCT Pub. Date: Jul. 8, 1999

Related U.S. Application Data

(63) Continuation-in-part of application No. 08/998,529, filed on Dec. 26, 1997, now Pat. No. 6,039,886.

(51) Int. Cl.[7] ..... E04H 4/16

(52) U.S. Cl. ..... 210/97; 210/90; 210/169; 210/138; 210/143; 210/416.2; 134/56 R; 15/1.7

(58) Field of Search ..... 210/90, 97, 169, 210/241, 406, 242.1, 416.2, 776, 85, 87, 143, 138, 525; 15/1.7, 319; 4/490; 134/21, 56 R, 57 R

(56) References Cited

U.S. PATENT DOCUMENTS

| | | | | |
|---|---|---|---|---|
| 3,860,518 | A | * | 1/1975 | Henricksen |
| 4,835,809 | A | * | 6/1989 | Roumagnac |
| 4,837,886 | A | * | 6/1989 | Rawlins |
| 5,077,853 | A | * | 1/1992 | Campbell |
| 6,039,886 | A | * | 3/2000 | Henkin et al. |

* cited by examiner

*Primary Examiner*—Joseph W. Drodge
*Assistant Examiner*—Terry K. Cecil
(74) *Attorney, Agent, or Firm*—Freilich, Hornbaker & Rosen

(57) ABSTRACT

A method and apparatus powered from the suction side of a pump for cleaning the interior surface of a pool containment wall and the upper surface of a water pool contained therein. The apparatus includes an essentially unitary cleaner body and a level control subsystem for selectively moving the body to a position either proximate to the surface of the water pool for water surface cleaning or proximate to the interior surface of the containment wall for wall surface cleaning. The cleaner body can have a weight/buoyancy characteristic to cause it to normally rest either (1) proximate to the pool bottom adjacent to the wall surface (i.e., heavier-than-water) or (2) proximate to the water surface (i.e.. lighter-than-water).

13 Claims, 26 Drawing Sheets

WATER SUCTION POWERED AUTOMATIC SWIMMING POOL CLEANING SYSTEM

This is a 371 of PCT/US98/27622, filed Dec. 28, 1998 which is a CIP of U.S. application Ser. No. 08/998,529, filed Dec. 26, 1997, now U.S. Pat. No. 6,039,886.

FIELD OF THE INVENTION

The present invention relates to a method and apparatus powered from the suction (i.e., negative pressure) side of a pump for cleaning a water pool; e.g., swimming pool.

BACKGROUND OF THE INVENTION

The prior art is replete with different types of automatic swimming pool cleaners powered from either the positive pressure side or suction side of a pump. They include water surface cleaning devices which typically float at the water surface and skim floating debris therefrom. The prior art also shows pool wall surface cleaning devices which typically rest at the pool bottom and can be moved along the wall (which term should be understood to include bottom and side portions) for wall cleaning, as by vacuuming and/or sweeping. Some prior art assemblies include both water surface cleaning and wall surface cleaning components tethered together.

SUMMARY OF THE INVENTION

The present invention is directed to a method and apparatus driven by water suction (i.e., negative pressure) for cleaning the interior surface of a pool containment wall and/or the upper surface of a water pool contained therein.

Apparatus in accordance with the invention includes (1) an essentially rigid unitary structure, i.e., a cleaner body, capable of being immersed in a water pool and (2) a level control subsystem for selectively moving the body to a position either (1) proximate to the surface of the water pool for water surface cleaning or (2) proximate to the interior surface of the containment wall for wall surface cleaning.

The invention can be embodied in a cleaner body having a weight/buoyancy characteristic to cause it to normally rest either (1) proximate to the pool bottom adjacent to the wall surface (i.e., heavier-than-water) or (2) proximate to the water surface (i.e., lighter-than-water). With the heavier-than-water body, the level control subsystem in an active state produces a vertical force component for lifting the body to proximate to the water surface for operation in a water surface cleaning mode. With the lighter-than-water body, the level control subsystem in an active state produces a vertical force component for causing the body to descend to the wall surface for operation in the wall surface cleaning mode.

A level control subsystem in accordance with the invention can produce the desired vertical force component either by discharging an appropriately directed water outflow from the body, and/or by modifying the body's weight/buoyancy characteristic, and/or by orientating hydrodynamic surfaces or adjusting the pitch of the body.

Embodiments of the invention preferably also include a propulsion control subsystem for producing a nominally horizontal (relative to the body) force component for moving the body along (1) a path adjacent to the water surface when the body is in the water surface cleaning mode and (2) a path adjacent to the wall surface when the body is in the wall surface cleaning mode. When in the water surface cleaning mode, debris is collected from the water surface, e.g., by skimming. When in the wall surface cleaning mode, debris is collected from the wall surface, e.g., by suction.

Embodiments of the invention are configured to be hydraulically powered from the suction side of an external hydraulic pump typically driven by an electric motor. This external pump generally comprises the normally available main pool pump used for pool water circulation. Proximal and distal ends of a flexible suction hose are respectively coupled to the pump and cleaner body for producing a water flow through the body for powering the aforementioned level control and propulsion subsystems. The hose is preferably configured with portions having a specific gravity >1.0 so that it typically lies at the bottom of the pool close to the wall surface with the hose distal end being pulled along by the movement of the body.

In preferred embodiments of the invention, the external pump draws a primary pool water inflow through the cleaner body. The primary inflow is used to develop vertical and horizontal force components capable of acting on the body to affect level control and propulsion. A preferred propulsion subsystem is operable in either a normal (i.e., forward) state for moving the body in a first direction, or a redirection (e.g., backup) state for moving the body in a second direction, e.g., laterally and/or rearwardly. Water surface cleaning and wall surface cleaning preferably occur during the forward propulsion state. The redirection state assists the body in freeing itself from obstructions.

The actual motion and orientation of the cleaner body at any instant in time is determined by the net effect of all forces acting on the body. Some of these forces are directly produced by outflows from the cleaner body. Other forces which effect the motion and orientation are attributable, inter alia, to the following:

a. the weight and buoyancy characteristics of the body
b. the hydrodynamic effects resulting from the relative movement between the water and body
c. the drag forces attributable to the suction hose
d. the contact forces of cleaner body parts against the wall surface, and other obstruction surfaces Preferred embodiments of the invention employ a turbine or other transducer which responds to the primary pool water inflow to drive a flow generator for producing one or more secondary flows. The secondary flows are then utilized to produce vertical and/or horizontal force components which act on the cleaner body for level control and/or propulsion. The flow generator can comprise a propeller or a pump utilizing, for example, a driven paddle wheel. For level control, the secondary flows can (1) be selectively directed by a switchable level flow director to discharge outflows which directly produce a vertical (upward or downward) thrust and/or (2) be used to control the weight/buoyancy characteristic and/or the pitch orientation of the body to enable it to rise or descend. For propulsion, the secondary flows are selectively directed by a switchable propulsion flow director to discharge outflows to produce force components for propulsion in either said first or second directions.

Additionally, the primary and/or secondary flows can be used for control purposes such as for driving a timing assembly to cause the flow directors to switch states.

A preferred cleaner body in accordance with the invention is comprised of a chassis supported on multiple traction wheels; e.g., a front wheel and first and second rear traction wheels. The wheels are mounted for rotation around horizontally oriented axles. The chassis is preferably configured with a nose portion proximate to the front wheel and front shoulders extending rearwardly therefrom. The shoulders taper outwardly from the nose portion to facilitate deflection off obstructions and to minimize drag as the body moves forwardly through the water. Side rails extending rearwardly from the outer ends of the shoulders toward a body tail portion can define chambers for affecting the body's weight/buoyancy characteristic.

A preferred cleaner body is configured so that, when at rest on a horizontal portion of the wall surface, it exhibits a nose-down, tail-up pitch or attitude. One or more hydrodynamic surfaces on the body creates a vertical force component for maintaining this attitude as the body moves through the water along a wall surface in the wall surface cleaning mode. This attitude facilitates hold down of the wheels against the wall surface and properly orients a vacuum inlet opening relative to the wall surface. When in the water surface cleaning mode, the vertical force component attributable to the hydrodynamic surface is minimized allowing the body to assume a more horizontally oriented attitude. This attitude facilitates movement along the water surface and/or facilitates skimming water from the surface into a debris container.

A preferred cleaner body in accordance with the invention carries a water permeable debris container. In the water surface cleaning mode, water skimmed from the surface flows through the debris container which removes and collects debris therefrom. In the wall surface cleaning mode, water from adjacent to the wall surface is drawn into the vacuum inlet opening and then through the suction hose and debris collector.

A preferred debris container comprises a main bag formed of mesh material containing one or more sheets or flaps configured to readily permit water home debris to flow therepast into the bag but prevent such debris from moving past the sheets in the opposite direction. More specifically, first and second sheets of flexible material are mounted in the bag such that one edge of the first sheet lies proximate to one edge of the second sheet. When the body is moving in its forward direction, pool water flowing into the bag acts to separate the sheet edges to enable debris to move past the edges into the bag. When the body is moving in a direction other than forward, e.g., rearward or laterally, water flow through the bag toward the mouth of the bag acts to close the sheet edges to prevent debris from leaving the bag.

The operating modes of the level control subsystem (i.e., (1) water surface and (2) wall surface) are preferably switched automatically in response to the occurrence of a particular event such as (1) the expiration of a time interval, (2) the cycling of the external pump, or (3) a state change of the propulsion subsystem. The operating states of the propulsion subsystem, i.e., (1) normal or forward and (2) redirection or backup are preferably switched automatically in response to the occurrence of a particular event such as the expiration of a time interval and/or the interruption of forward body motion.

Multiple exemplary embodiments of the invention will be described hereinafter. They are generally characterized by (1) a turbine mounted so as to be driven by the primary inflow and (2) a flow generator driven by the turbine to produce secondary flows. The secondary flows are selectively directed to place the cleaner body proximate to the water surface or wall surface and/or to propel the body therealong.

In a first embodiment using a heavier-than-water body, the level control subsystem in its active state produces a water outflow from the body in a direction having a vertical component sufficient to lift the body to the water surface for water surface cleaning.

In second, third, fourth, fifth, and sixth embodiments, the level control subsystem utilizes one or more hollow chambers carried by the cleaner body for selectively modifying the weight/buoyancy characteristic of the body. More particularly, the subsystem selectively fills the chamber(s) with either (1) air to make the body more buoyant for operation in the water surface cleaning mode or (2) water to increase the body's weight for operation in the wall surface cleaning mode.

In the second and fifth embodiments (heavier-than-water) (FIG. 11), the level control subsystem in an active state produces a water outflow from the body in a direction having a vertical component for producing lift. Additionally, water is selectively evacuated from a body chamber by an on-board water driven pump to enable outside air to be pulled into the chamber when the body is at the water surface to increase the body's buoyancy and stability.

In the third embodiment (heavier-than-water) (FIG. 12), a body chamber contains an air bag coupled to an on-board air reservoir. When in a quiescent state, the chamber is water filled and the air bag is collapsed. In order to lift the body to the water surface, suction pulls water out of the chamber enabling the air bag to expand to thus change the body's weight/buoyancy characteristic and allow it to float to the water surface.

In the fourth embodiment (FIG. 13), the body is configured with at least one chamber which contains a bag filled with air when in its quiescent state. The contained air volume is sufficient to float the body to the water surface. In order to move the body to the wall surface, the level control subsystem in its active state supplies pressurized water to fill the chamber and collapse the bag, pushing the contained air under pressure into an air reservoir.

In a sixth embodiment (FIG. 22, 26) a pitch control subsystem is incorporated to selectively orient the body's pitch to be either nose (i.e., front) up/tail (i.e., rear) down or nose down/tail up. By selectively orienting the pitch of the body and providing forward propulsion, as from a single jet, the body can be driven either up to the water surface or down to the wall surface. The pitch control subsystem can be implemented by shifting weight and/or buoyancy between the front and rear of the body.

A seventh embodiment (FIG. 29) uses buoyancy modification to float or sink the body. A buoyancy control subsystem is provided including at least one chamber containing a flaccid bag. To float the body, the bag is filled with air provided by a snorkel device. To sink the body, the chamber is filled with water which expels the air from the bag.

In accordance with a useful feature of some embodiments of the invention, one or more traction wheels are driven (e.g., by the primary inflow) to facilitate movement of the body along the wall surface. The periphery of the front wheel can be notched to facilitate it rolling over a hose, e.g., the suction hose, which it may encounter in traversing the pool bottom. Still further, the peripheral surface of the front wheel preferably has a lower coefficient of friction then that of the rear wheels to facilitate the body turning from a straight line travel path.

In accordance with a further feature of some embodiments, a water driven (e.g., by the primary inflow) controller subsystem controls the switching of the level flow director and/or the direction flow director.

Preferably all of the embodiments include a level override control for enabling a user to selectively place the level flow director in either the wall surface cleaning mode or the water surface cleaning mode.

Although multiple specific embodiments of cleaner bodies and level and propulsion control subsystems in accordance with the invention are described herein, it should be recognized that many alternative implementations can be configured in accordance with the invention to satisfy particular operational or cost objectives. For example only, selected features from two or more embodiments may be readily combined to configure a further embodiment.

Among the more significant features is the inclusion of a motion sensor mechanism to sense when the rate of forward motion of the cleaner body diminishes below a certain threshold. This can occur, for example, when the body gets trapped behind an obstruction. By sensing the motion decrease, a redirection state can be initiated to move the body laterally and/or rearwardly to free it of the obstruction. This motion sensing feature has potential application in various types of pool cleaners regardless of whether they operate at both the water surface and wall surface. In accordance with a preferred embodiment, the motion sensor operates in conjunction with a periodic control device, e.g., a direction controller which alternately defines first and second conditions. Redirection is initiated when two conditions occur concurrently; i.e., the periodic control device defining the second condition and the motion sensor indicating that forward motion has diminished below the threshold.

In accordance with a further useful feature, a suction indicator carried by the body is preferably coupled to the water distribution system to indicate to a user whether the magnitude of negative pressure being delivered to the body is within an acceptable operating range.

DESCRIPTION OF PREFERRED EMBODIMENTS

Figure 1:
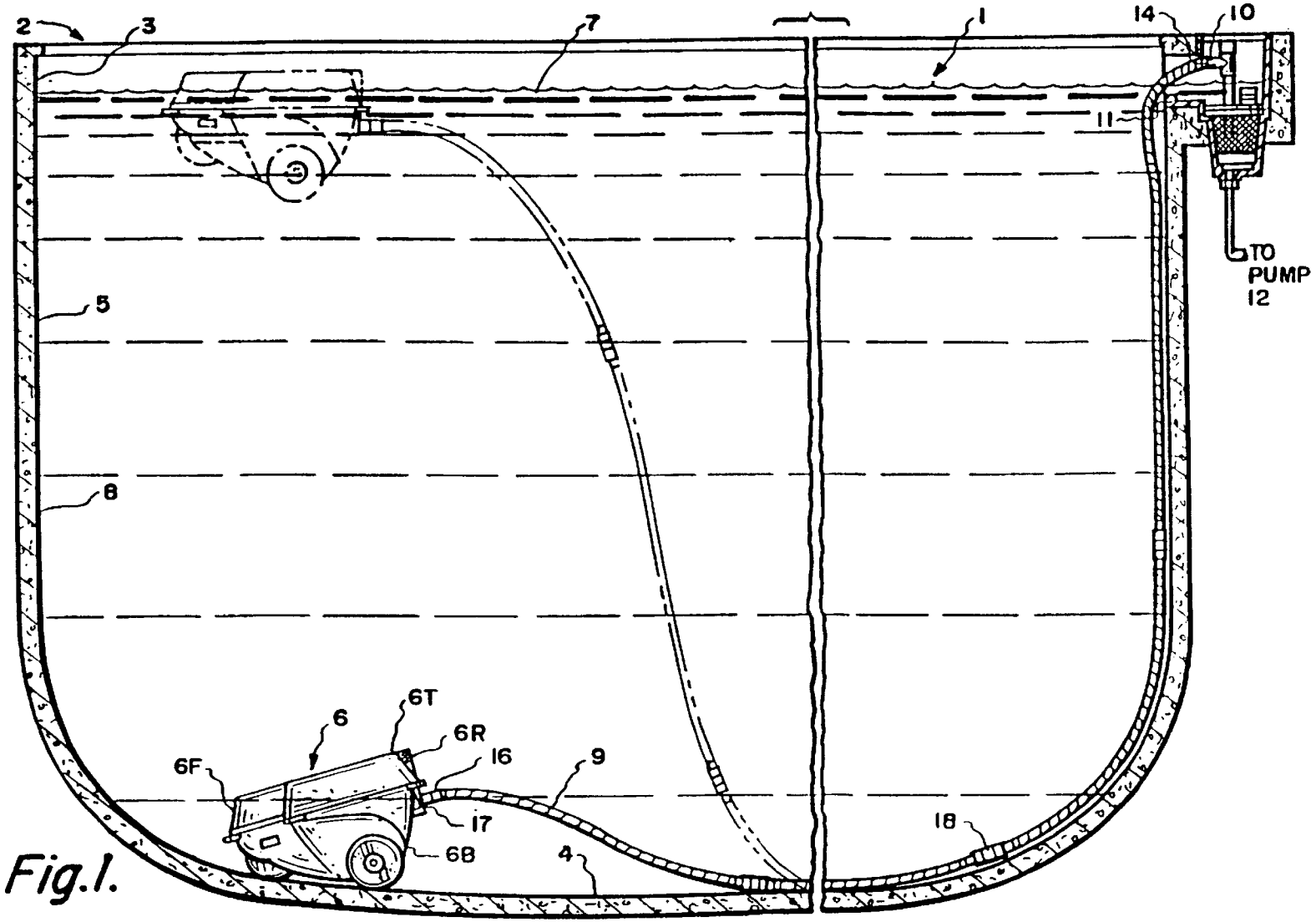
FIG. 1 schematically depicts a suction driven cleaning system in accordance with the invention showing a cleaner body operating respectively in (1) a water surface cleaning mode (dashed line) and (2) a wall surface cleaning mode (solid line)

With reference to FIG. 1, the present invention is directed to a method and apparatus for cleaning a water pool 1 contained in an open vessel 2 defined by a containment wall 3 having bottom 4 and side 5 portions. Embodiments of the invention utilize a unitary structure or body 6 configured for immersion in the water pool 1 for selective operation proximate to the water surface 7 in a water surface cleaning mode or proximate to the interior wall surface 8 in a wall surface cleaning mode.

The unitary body 6 preferably comprises an essentially rigid structure having a hydrodynamically contoured exterior surface for efficient travel through the water. Although the body 6 can be variously configured in accordance with the invention, it is intended that it be relatively compact in size, preferably fitting within a two foot cube envelope. FIG. 1 depicts a heavier-than-water body 6 which in its quiescent or rest state typically sinks to a position (represented in solid line) proximate to the bottom of the pool 1. For operation in the water surface cleaning mode, a vertical force is produced to lift the body 6 to proximate to the water surface 7 (represented in dash line). Alternatively, body 6 can be configured to be lighter-than-water, i.e., having a weight/buoyancy characteristic such that in its quiescent or rest state, it floats proximate to the water surface 7. For operation in the wall surface cleaning mode, a vertical force is produced to cause the lighter-than-water body to descend to the pool bottom. In either case, the vertical force is produced as a consequence of a water flow pulled via flexible hose 9 to a suction port 10 which can typically be conveniently accessed in built-in skimmer 11. In any event, the port 10 is coupled via tubing to the suction side of an electrically driven hydraulic pump 12. Pressure regulator 14 and quick disconnect coupling 16 preferably respectively couple the proximal and distal ends of hose 9 to the suction port 10 and the primary outlet 17 of cleaner body 6. The hose 9 is preferably formed of multiple sections coupled in tandem by friction fits and swivels 18. Further, the hose 9 is preferably configured with appropriately placed distributed weight so that a significant portion of its length normally rests on the bottom of wall surface 8.

As represented in FIG. 1, the body 6 generally comprises a top portion or frame 6T and a bottom portion or chassis 6B, spaced in a nominally vertical direction. The body also generally defines a front or nose portion 6F and a rear or tail portion 6R spaced in a nominally horizontal direction. The body is supported on a traction means such as wheels 20 which are mounted for engaging the wall surface 8 when operating in the wall surface cleaning mode.

The invention is based, in part, on a recognition that inasmuch as most debris initially floats on the water surface prior to sinking to the wall surface, the overall cleaning task can be optimized by removing debris from the water surface before it sinks. Thus a cleaner body capable of floating or otherwise traveling to where the debris floats can capture debris more effectively than a fixed position skimmer. A cleaner body 6 in accordance with the invention selectively operates proximate to the water surface in a water surface cleaning mode and proximate to the wall surface in a wall surface cleaning mode. The operating level of the cleaner body in the water pool, i.e., proximate to the water surface or proximate to the wall surface, is controlled by a level control subsystem, to be described hereinafter, capable of selectively defining either a water surface mode or a wall surface mode. The mode defined by the subsystem is selected via a user control, e.g., a manual switch or valve, or via an event sensor responsive to an event such as the expiration of a time interval. The movement of the body in the water pool is preferably controlled by a propulsion subsystem to selectively propel the body in either a first, e.g., forward direction or a second, e.g., rearward direction. The direction is preferably selected via an event sensor which responds to an event such as the expiration of a time interval or an interruption of the body's motion. In typical operation, the body 6 alternately operates in (1) the water surface cleaning mode to capture floating debris and (2) the wall surface cleaning mode in which it travels along bottom and side wall portions to clean debris from the wall surface 8.

Multiple exemplary embodiments of the invention will be described hereinafter. Some of these embodiments (e.g., FIGS. 5, 11, 12, 14, 22, 26) will be assumed to have a weight/buoyancy characteristic to cause it to normally rest proximate to the bottom of pool 1 adjacent to the wall surface 8 (i.e., heavier-than-water). One embodiment (FIG. 13) will be assumed to have a characteristic to cause it to rest (i.e., float) proximate to the water surface 7 (i. e., lighter-than-water).

Figure 2:
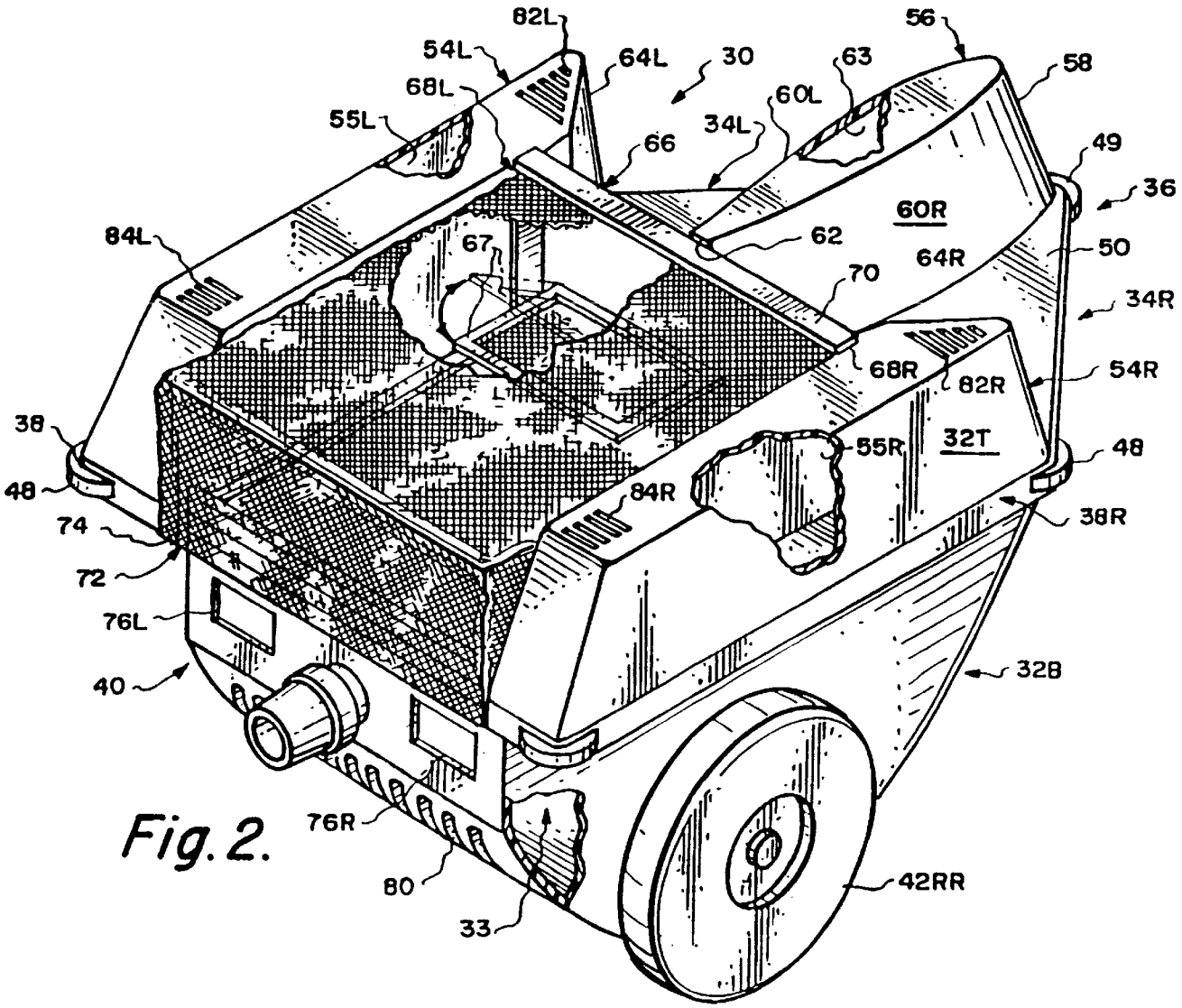
FIG. 2 is an isometric external top view of the cleaner body of FIG. 1.
Figure 3:
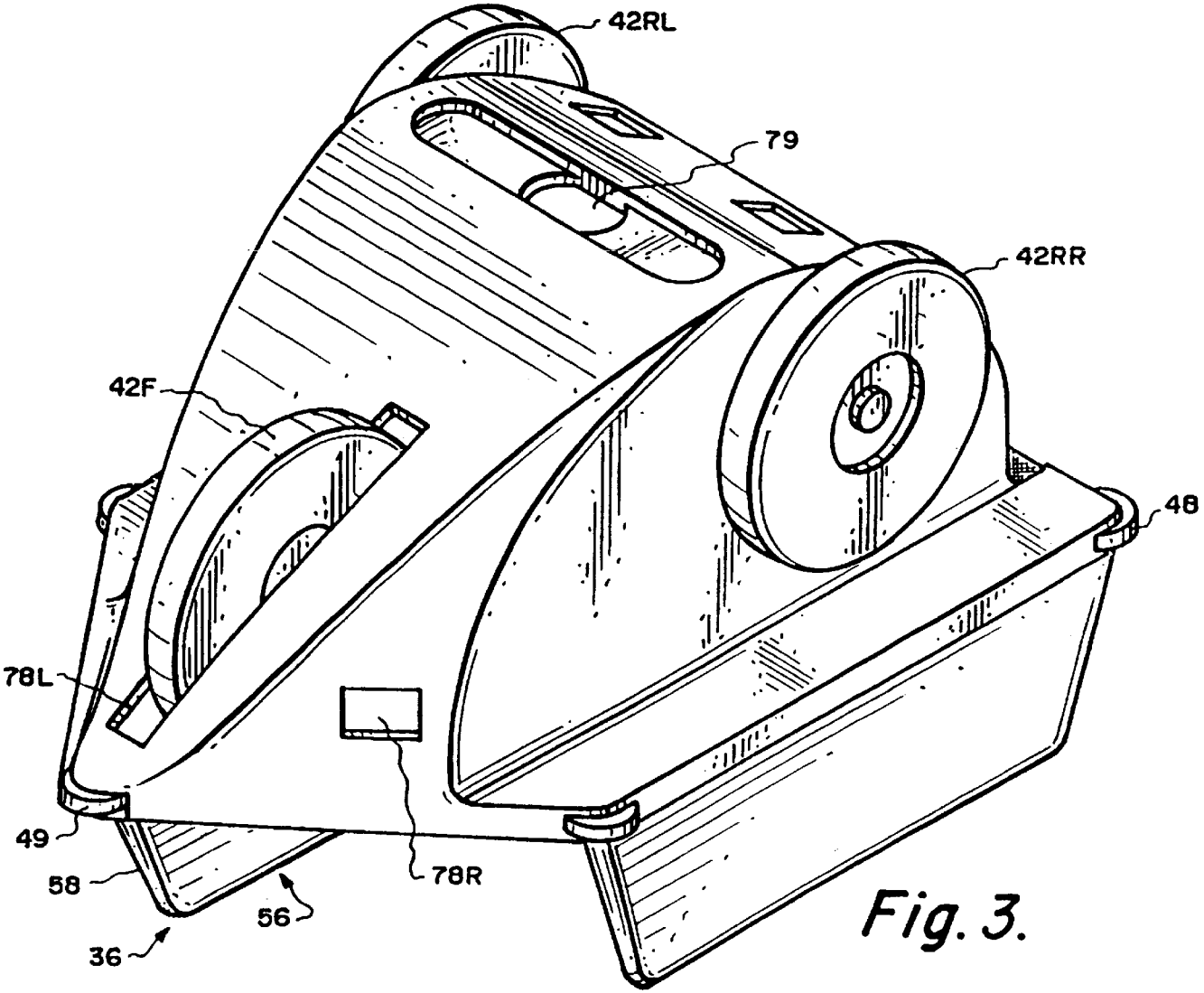
FIG. 3 is an isometric external bottom view of the cleaner body of FIG. 1.

Attention is now directed to FIGS. 2 and 3 which respectively show isometric top and bottom views of an exemplary embodiment 30 of body 6 comprised of upper and lower molded sections 32T and 328. The lower section or chassis 32B comprises an open concave member defining an internal volume 33 for accommodating a water distribution system to be discussed hereinafter, in connection with FIGS. 5, 11, 12, 13, 14, 22, 26. The chassis 32B defines left and right shoulder rails 34L, 34R which diverge rearwardly from a chassis nose portion 36. Side rails 38L, 38R extend rearwardly from the shoulder rails 34L, 34R toward the rear or tail end 40 of the chassis 32B. The chassis is supported on three traction wheels 42 mounted for rotation around horizontally oriented parallel axis. More particularly, the wheels 42 are comprised of a front center wheel 42F mounted proximate to the chassis nose portion 36, and rear left and rear right wheels 42RL and 42RR. The wheels have circumferential surfaces, e.g., tires, preferably having a sufficiently high coefficient of friction to normally guide the body along a path essentially parallel to its longitudinal axis. However, front wheel 42F preferably has a somewhat lower coefficient of friction than wheels 42RL and 42RR to facilitate turning.

The chassis 32B preferably carries a plurality of horizontally oriented guide wheels 48, including nose wheel 49, mounted around the chassis perimeter for free rotation around vertical axes to facilitate movement of the body past wall and other obstruction surfaces.

The body upper section or frame 32T defines a perimeter essentially matching that of the chassis 32B. The frame is comprised of a deck 50 having upstanding side walls 54L and 54R extending therefrom. The walls 54L, 54R defines interior chambers 55L, 55R which, in the embodiment represented by FIG. 5, preferably contain flotation material, e.g., solid foam, which partially defines the weight/buoyancy characteristic of the body. As will be seen hereinafter, in the embodiments represented in FIGS. 11, 12, 13, 14, 22, 26, the interior chambers in walls 54 can be selectively filled with air or water to modify the body's weight/buoyancy characteristic.

The frame 32T carries a front fin 56 which is centrally mounted on deck 50 proximate to the forward or nose portion 36. The fin 56 is shaped with a rounded front surface 58 and with side surfaces 60L and 60R converging toward a rear edge 62. Similarly to walls 54L, 54R, fin 56 contains an interior chamber 63 which is similarly used to achieve the desired weight/buoyancy characteristic. Side walls 54L, 54R respectively define converging entrance surfaces 64L, 64R which guide water moving past fin 56 toward debris opening 66, past weir 67. Weir 67 is framed by deck 50 and side walls 54L, 54R. Slots 68L, 68R are formed on the side wall inner surfaces for removably accommodating an open frame member 70. Frame member 70 has a debris container 72, preferably comprising a bag formed of flexible mesh material 74, secured thereto so that water flow into opening 66 will flow through container 72 which will capture waterborne debris.

Also note in FIGS. 2 and 3 that chassis 32B defines openings 76L, 76R 77L, 77R near the tail end 40 and openings 78L, 78R near the nose end 36 and vacuum inlet 79 near the bottom. Also note openings 80 in the chassis 32B which open into its internal volume 33. Additionally, note openings 82L, 82R and 84L, 84R which open into the side wall chambers 55. The function of all these openings will be discussed hereinafter.

FIRST EMBODIMENT (FIGS. 4–10)

Figure 4:
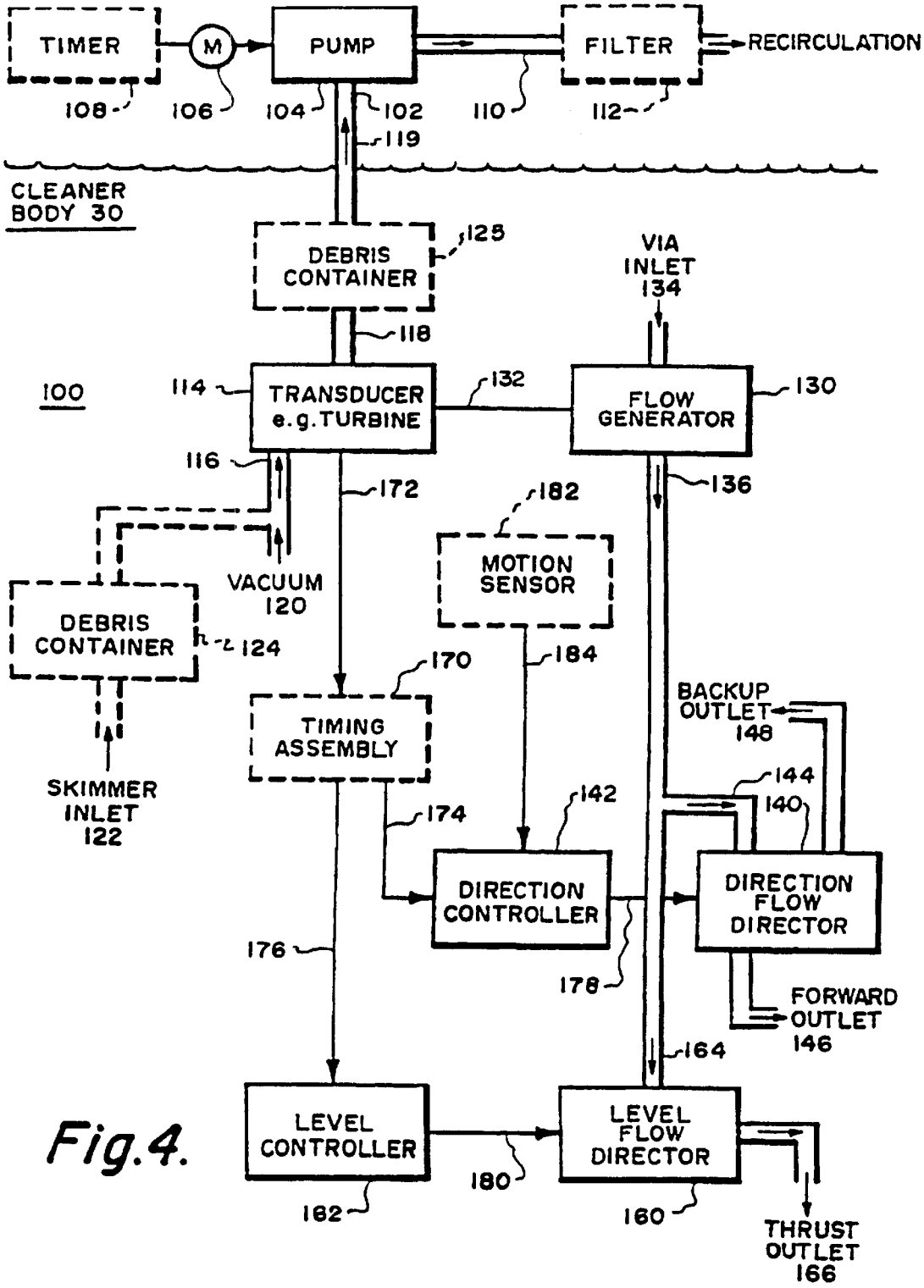
FIG. 4 is a functional block diagram generally depicting water flow distribution in accordance with a first embodiment of the invention.

Attention is now directed to FIG. 4 which comprises a functional block diagram of a first embodiment 100 of the invention intended to be powered from the suction side 102 of a hydraulic pump 104 driven by an electric motor 106 controlled by an optional timer 108. The pump 104 can typically comprise the normally available main pool pump used for water recirculation via pump outlet 110 and filter 112.

The functional elements of the embodiment 100 depicted in FIG. 4 are physically housed in cleaner body 30 (FIGS. 2, 3) and include:

a. A transducer, preferably a turbine, 114 having an inlet 116 and an outlet 118 coupled by a hose 119 to the suction side 102 of pump 104. The inlet 116 opens to the water pool 1 preferably via a vacuum inlet 120 and/or a skimmer inlet 122. A debris container 124 can optionally be incorporated between inlets 120 and/or 122 and turbine inlet 116. Additionally, a debris container 125 can optionally be incorporated between the turbine and pump 104.

b. A flow generator 130 driven, e.g., by transducer drive shaft 132, to draw pool water in via inlet 134 for discharge via outlet 136.

c. A direction flow director 140 operable in either a forward state or a backup state. The state of flow director 140 is controlled by direction controller 142. When in the forward state, flow director 140 directs an inflow from inlet 144 out through forward outlet 146 to produce a force on body 6 to move the body in a first or forward direction. When in the backup state, flow director 140 directs the inflow from inlet 144 out through backup outlet 148 to develop a force on body 6 to move it in a second, e.g., rearward, sideward, and/or vertical direction.

d. A level flow director 160 operable in either a water surface mode or a wall surface mode. The mode of flow director 160 is controlled by level controller 162. Assuming an embodiment which normally rests at the wall surface, when the flow director 160 is in the water surface mode, it directs an inflow from inlet 164 out through thrust outlet 166 to produce a vertical force component to lift the body 30 to the water surface. Alternatively, if the body normally rests at the water surface, thrust outlet 166 would be oriented to discharge an outflow to produce a vertical force component to cause the body to descend to the wall surface.

e. An optional timing assembly 170 driven, e.g., by transducer drive shaft 172 periodically switches the state of controller 142 and/or the mode of controller 162, e.g., via members 174, 176, respectively. Controllers 142, 162 respectively control flow directors 140, 160 via control members 178, 180.

f. An optional motion sensor 182 is provided to sense when the body's forward motion diminishes below a certain threshold. When this occurs, sensor 182, via control member 184, initiates an action to switch controller 142 to its backup state.

Figure 5:
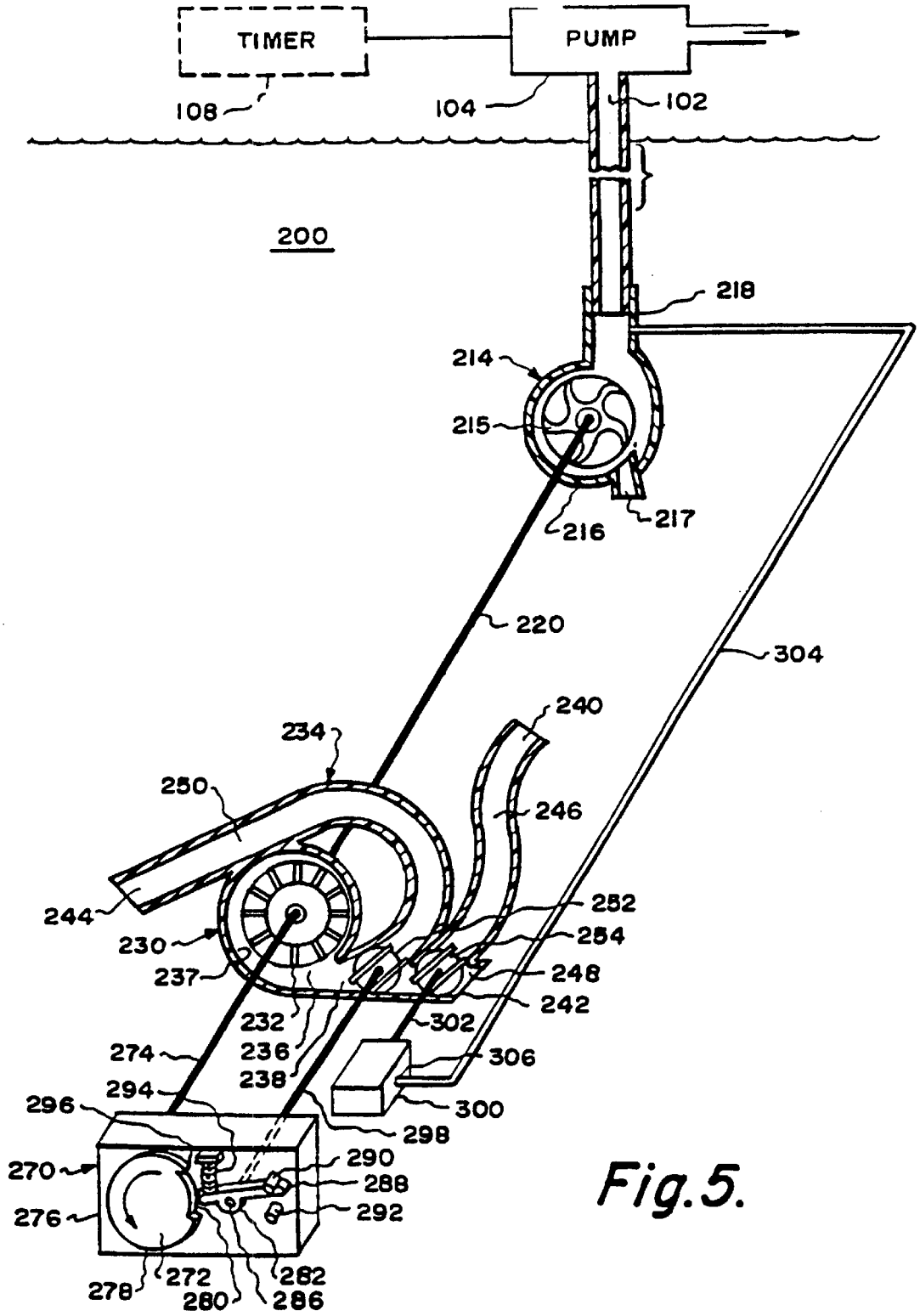
FIG. 5 is an isometric illustration schematically depicting an implementation of the water flow distribution of FIG. 4 in accordance with the first embodiment of the invention.

Attention is now directed to FIG. 5 which schematically depicts an exemplary implementation 200 of the block diagram of FIG. 4. The implementation 200 includes a turbine 214 comprised of a rotor 215 mounted for rotation in housing 216. Housing 216 defines a pool water inlet 217, e.g., vacuum inlet 79, and outlet 218 coupled to the pump suction side 102. The rotor 215 rotates a drive shaft 220 which is coupled to a flow generator 230 comprised of a paddle wheel 232 mounted for rotation in housing 234. Housing 234 defines an internal chamber 236 accommodating the paddle wheel 232. The chamber 236 is normally flooded with water via inlet port 237 so that, as the paddle wheel 232 rotates, it expels water through the chamber outlet port 238. The water expelled via outlet port 238 is then directed to one or more housing outlets 240, 242, and 244 via respective passageways 246, 248, and 250 by valves 252 and 254. As will be discussed in connection with FIGS. 6–10, the housing 234 is oriented in body 30 such that (1) outlet 240 discharges a flow essentially rearwardly and upwardly, (2) outlet 242 discharges a flow essentially rearwardly and downwardly, and (3) outlet 244 discharges a flow essentially forwardly and downwardly and sidewardly.

Valves 252, 254 respectively perform the functions of the direction flow director 140 and the level flow director 160 described in FIG. 4. The direction valve 252 is mounted for movement between a clockwise (CW) position and a counter-clockwise (CCW) position. In the CCW position, as depicted in FIG. 5, the flow expelled via chamber outlet port 238 is directed along passageway 250 to outlet 244. In the CW position, valve 252 closes passageway 250 and directs the flow from outlet port 238 toward passageways 246 and 248.

The level valve 254 is similarly mounted for movement between a CW and a CCW position. In the CCW position, as depicted in FIG. 3, the flow expelled from port 238 is directed along passageway 246 to outlet 240. In the CW position, valve 254 closes passageway 246 and directs the flow from port 238 out through outlet 242.

The position of the direction valve 252 is controlled by direction controller 270 comprising a timing cam 272 mounted for rotation by drive shaft extension 274 via gearing (not shown) internal to housing 276. Timing cam 272 defines a circumferential cam surface 278 having a reduced diameter portion 280 extending along a small portion of its circumference, e.g., 15° to 90°.

A rocker arm 282 is mounted for pivotal movement about axis 286 between a CCW position whereat arm first end 288 engages stop 290 and a CW position whereat end 288 engages stop 292. A spring 294 bears against arm end 296 to bias the rocker arm 282 to its CCW position. The rocker arm 282 is directly coupled to the direction valve 252 by rod 298.

As the timing cam 272 is rotated counter clockwise (FIG. 5) by drive shaft extension 274, cam surface 278 will engage arm end 296 to pivot rocker arm 282 to its clockwise position against the action of spring 294. However, when the reduced diameter cam surface portion 280 moves into position adjacent rocker arm end 296, spring 294 pivots rocker arm 282 to its CCW position.

The position of the level valve 254 is controlled by level 300 via rod 302. The level controller 300 in FIG. 5 comprises an alternating actuator hydraulically controlled by the suction communicated via tube 304 from the pump 104. More particularly, the implementation of FIG. 5 contemplates that controller 300 comprises an alternating mechanism which switches between first and second states each time suction is applied to control port 306 via tube 304. In other words, each time pump 104 comes "on" it switches the state of controller 300 and thus the position of valve 254 which determines whether a water flow is discharged from outlet 240 (wall surface mode) or outlet 242 (water surface mode).

Figure 9:
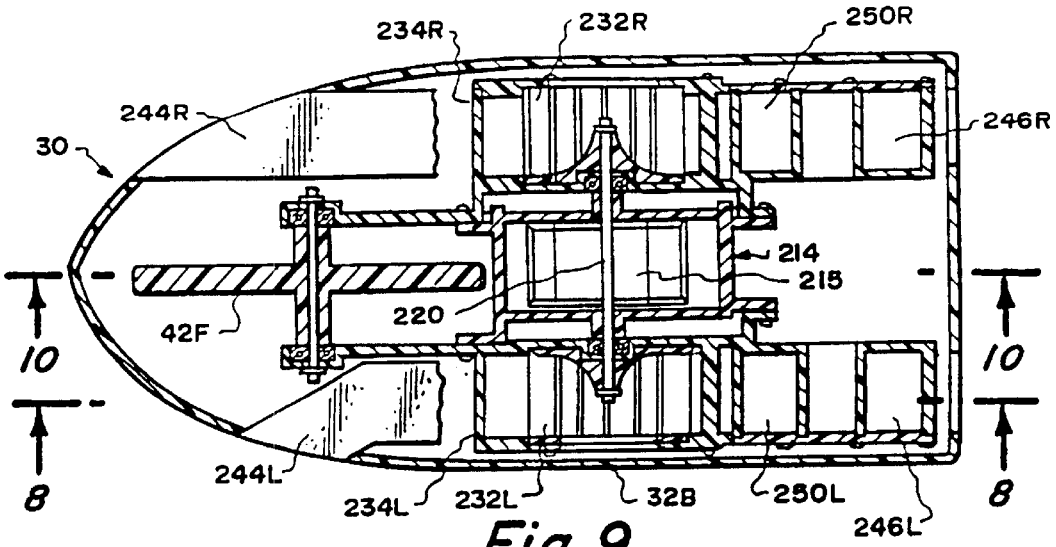
FIG. 9 is a sectional view taken substantially along the plane 9—9 of FIG. 8.

It is pointed out that for clarity of presentation, only a single housing 234 is depicted in the schematic diagram of FIG. 5. In a preferred structural embodiment, however, as represented in FIG. 9, left and right-housings 234L, 234R are used respectively located to each side of centrally disposed turbine housing 214. The housings 234L, 234R are substantially identical, respectively including paddle wheels 232L, 232R driven by the turbine drive shaft 220, as well as a direction valve 252 driven by control member 298 and level valve 254 driven by control member 302.

Figure 6:
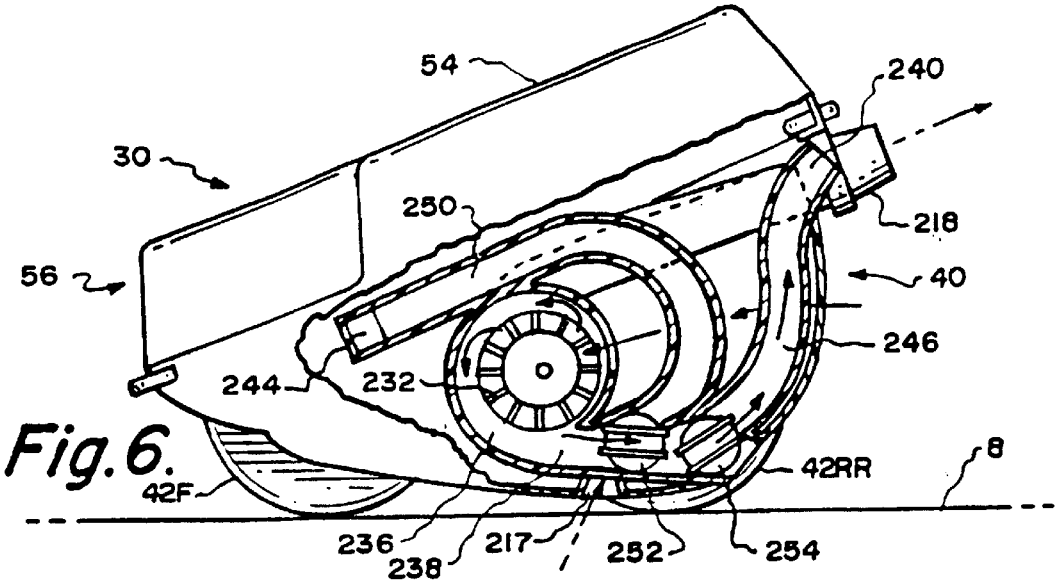
FIG. 6 is a side view of a cleaner body, partially broken away, in accordance with said first embodiment showing the body attitude and water flow outlets active during the wall surface cleaning mode.
Figure 7:
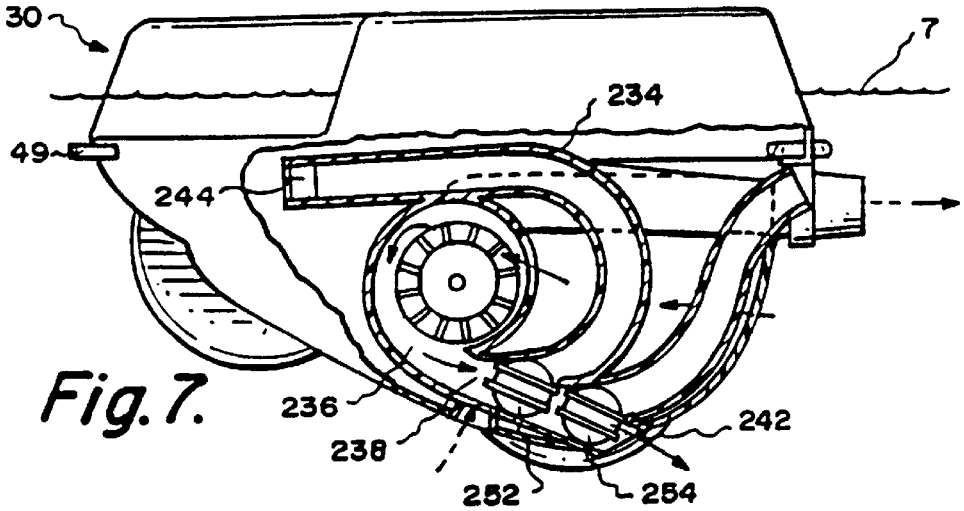
FIG. 7 is a side view similar to FIG. 6 showing attitude and water flow during the water surface cleaning mode.
Figure 8:
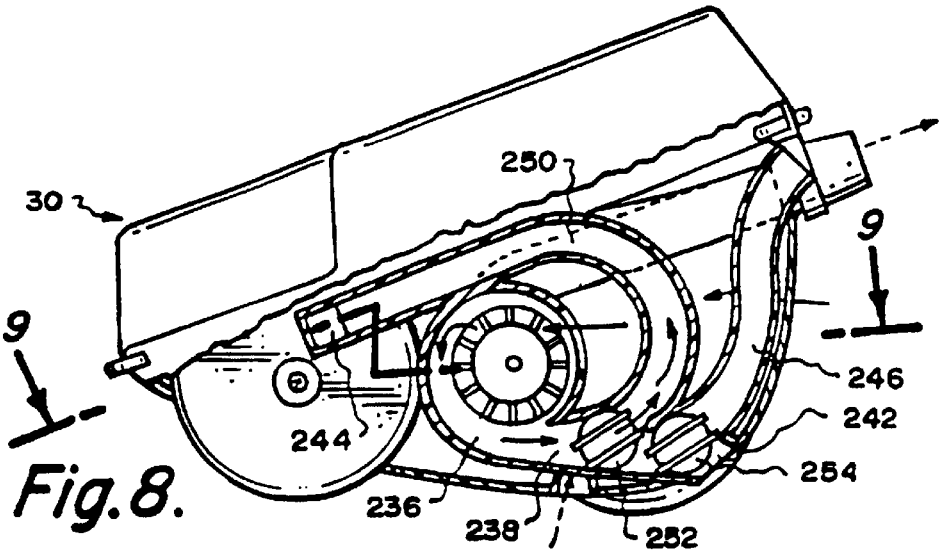
FIG. 8 is a side view similar to FIG. 6 showing attitude and water flow during the backup state.

FIGS. 6, 7, and 8, respectively depict the cleaner body 30 operating in the wall surface cleaning mode, the water surface cleaning mode, and the backup state. The body 30 is shown broken away in order to depict the relative orientation of the flow generator housing 234 for each of the operating modes and states. Thus, note in the wall surface cleaning mode (FIG. 6), that the wheels 42F, 42RR engage the containment wall interior surface 8 and the body 30 exhibits a nose down, tail up attitude. Note also that the direction valve 252 and level valve 254 are respectively depicted in their CW and CCW positions. As a consequence, the flow expelled from chamber 236 via port 238 is directed through passageway 246 to outlet 240 (via openings 76L, 76R in FIG. 2). The discharge from outlet 240 has a vertical upward component which produces a downward reaction force acting to hold the wheels 42 against the surface 8. Note that this position orients the vacuum inlet close to the surface 8 to facilitate debris removal. The flow out of outlet 240 additionally has a rearwardly directed component which produces a reaction force to propel the body 30 forwardly. Forward motion of the body through the water also produces a downward force on the body, e.g., on deck 50, acting to hold the wheels 42 against the surface 8.

FIG. 7 depicts the body 30 operating in the water surface mode in which the body is propelled along the water surface 7 in a horizontally oriented attitude. In the water surface mode, the direction valve 252 and level valve 254 are both in their CW positions so that water expelled by the paddle wheel via port 238 is discharged through outlet 242 (via openings 77L, 77R in FIG. 3) in a downward and rearward direction to provide both lift and forward propulsion.

FIGS. 6 and 7 both depict flow discharge rearwardly to propel the body 30 forwardly. FIG. 8 depicts the body in its backup state in which valve 252 is in its CCW position. As a consequence, the flow discharged from chamber 236 via outlet 238 is directed through passageway 250 to outlet 244. Discharge through outlet 244 is in a forward, downward and sideward direction which produces a reaction force to lift, rotate, and move the body rearwardly.

Figure 10:
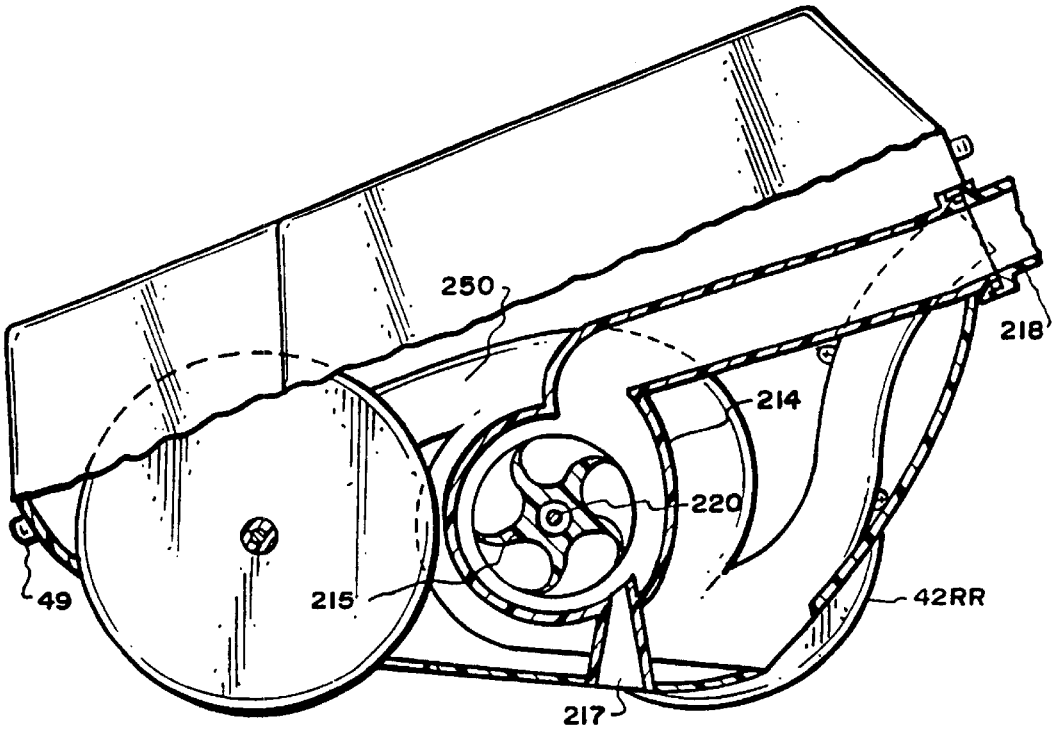
FIG. 10 is a sectional view taken substantially along the plane 10—10 of FIG. 9.

FIGS. 9 and 10 are sectional views which better illustrate the left and right flow generator housings 234L, 234R mounted within the chassis 32B on either side of the centrally located turbine housing 214. Note in FIG. 9, that the letters "L" and "R" have been appended to elements associated with the left housing 234L and right housing 234R, respectively. The housings 234L and 234R are substantially identical but preferably differ in the orientations of the passageways 250L and 250R leading to outlets 244L and 244R. More particularly, to enable the body to optimally free itself from obstructions, it is desirable to produce rearward, lift, and turning thrust components acting on the body when in the backup state. This is achieved, as depicted in FIG. 9, by orienting outlet 244R to discharge forwardly and downwardly and outlet 244L to discharge forwardly, sidewardly and downwardly.

In operation, as the body moves forwardly along the wall surface in the wall surface mode, it will vacuum water and debris from the wall surface via vacuum inlet (79, FIG. 3; 120, FIG. 4). In the water surface mode, as the body moves forwardly along the water surface, floating debris move over deck 50 and weir 67 and through debris opening 66 into debris container 72. The weir 67 serves to prevent debris from escaping from container 72 when the body is not moving forward.

SECOND EMBODIMENT (FIGS. 11A, 11B)

In the first embodiment depicted in FIGS. 4–10, the heavier-than-water body 30 is lifted to and stabilized at the water surface by a vertical force produced primarily by water outflow from the body outlet 242 in a direction having a vertical component.

Figures 11A, 11B:
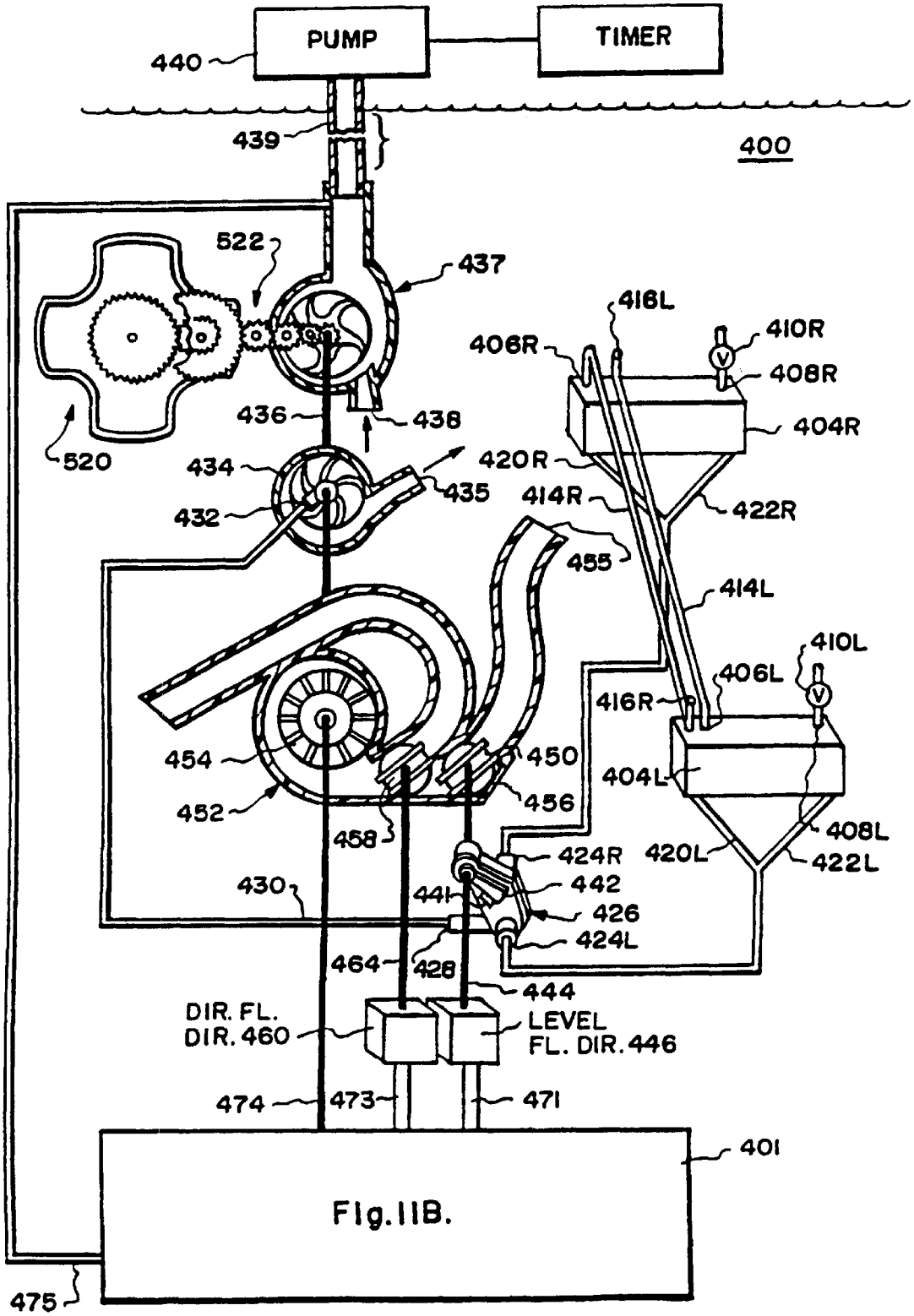
FIG. 11A is an isometric illustration schematically depicting an implementation of water flow distribution in a second embodiment of the invention and FIG. 11B is an isometric illustration of a preferred controller subsystem for use in FIG. 11A.
Figure 11B:
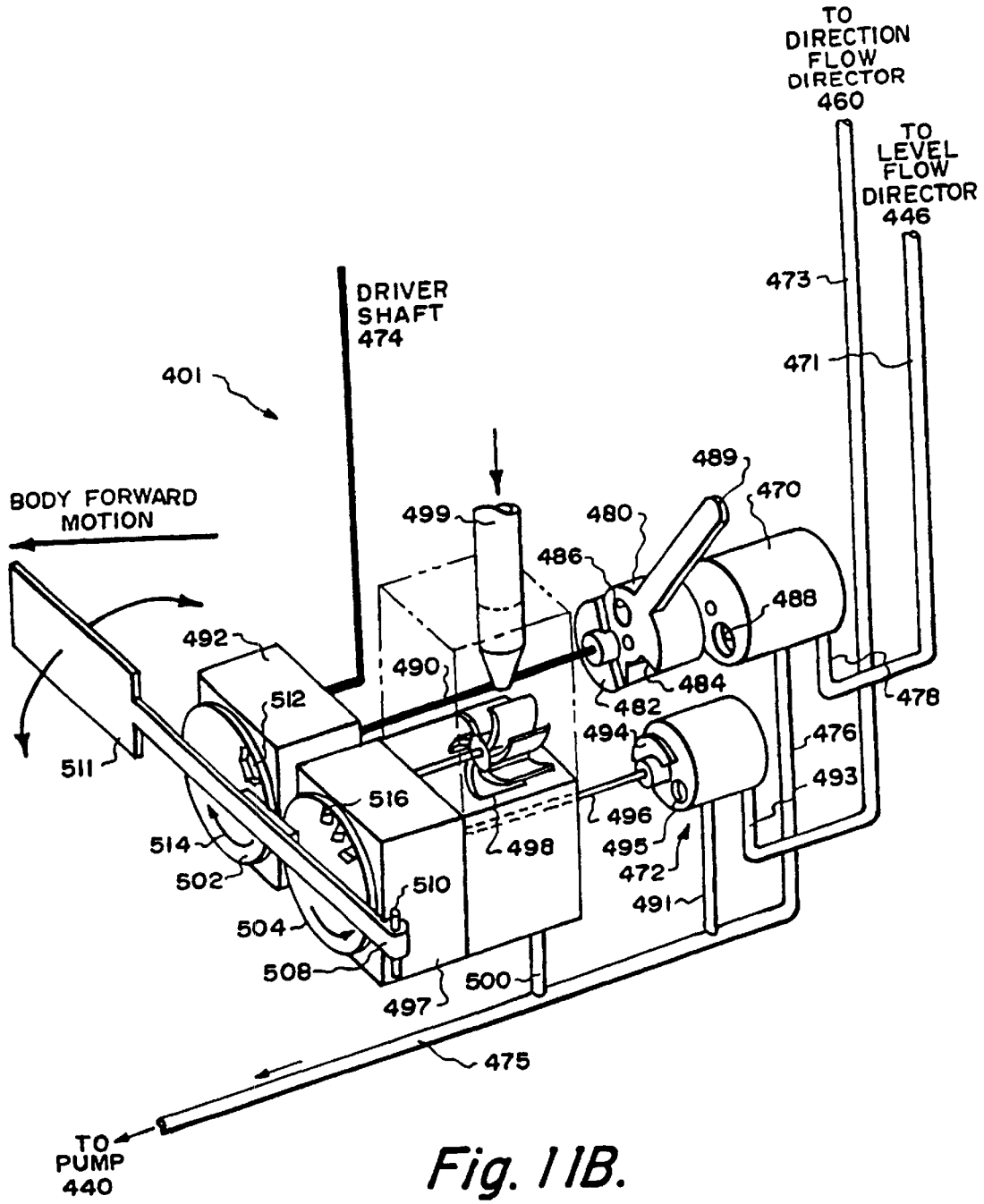

In the second heavier-than-water embodiment 400 depicted in FIG. 11A, the body is lifted to the water surface in essentially the same manner as in the first embodiment. However, the vertical force to stabilize the body at the water surface is produced in part by selectively modifying the body's weight/buoyancy characteristic. More particularly, the embodiment 400 of FIG. 11A (which is controlled by the controller subsystem 401 of FIG. 11B), is configured similarly to the embodiment of FIG. 5 but differs primarily in that left and right stabilization chambers 404L, 404R defined within aforementioned side walls 54L, 54R are selectively filled with water (wall surface mode) or air (water surface mode) to modify the body's weight/buoyancy characteristic. Note that chamber 404L has two ports defined on its top surface; namely, front port 406L and rear port 408L. Rear port 408L accommodates a check valve 410L to allow air flow out of chamber 404L. Front port 406L is coupled via tube 414L which preferably extends across the beam of the body to entrance opening 416L located proximate to right chamber 404R. Chamber 404R similarly defines front port 406R and rear port 408R. Front port 406R is coupled via tube 414R to entrance opening 416R located proximate to left chamber 404L. Rear port 408R preferably accommodates check valve 410R to allow air flow out of chamber 404R. The function and operation of chambers 404L, 404R will be described hereinafter.

The chambers 404L, 404R also have bottom front drain lines 420L, 420R and bottom rear drain lines 422L, 422R which extend to suction inlets 424L, 424R of a flood valve 426. Flood valve 426 defines a suction outlet 428 which is coupled via tube 430 to a suction inlet 432 on centrifugal pump 434 having a discharge outlet 435. Pump 434 is driven by drive shaft 436 of main turbine 437. Turbine 437, which corresponds to previously discussed turbine 214, is driven by pool water drawn through vacuum inlet 438 to the suction side 439 of electrically powered pump 440.

Flood valve 426 additionally defines water inlet 441 which will either be open or closed to ambient pool water depending on the rotational position of valve element 442. Valve element 442 is controlled by control member 444 of level flow director 446. Level flow director 446 also controls the position of level valve 450 in housing 452. That is, for the water surface cleaning mode, level flow director 446 moves level valve 450 from its default CCW position to its CW position. In the wall surface cleaning mode, flow director 446 allows valve 450 to return to its default CCW position. In the CCW and CW positions, respectively, flow generator 454 discharges its flow via outlets 455 and 456 (corresponding to aforementioned outlets 240 and 242).

FIG. 11A also illustrates direction valve 458 which is controlled by direction flow director 460 via control member 464. Direction control member 464 and previously mentioned level control member 444 comprise rods or shafts mounted for limited rotation, e.g., through 45°. The level control member 444 and the direction control member 464 are respectively controlled by level controller 470 and direction controller 472 shown in the controller subsystem depicted in FIG. 11B. Before discussing the subsystem of FIG. 11B, attention is called to the following table which summarizes the various operating conditions for the system of FIG. 11A:

| | Mode/State | Level V.450 | Dir. V.458 | Flood V.426 | Latch Bar 508 |
|---|---|---|---|---|---|
| 1. (default) | Wall/Backup | CCW | CCW | Open | Released |
| 2. | Wall/Normal | CCW | CW | Open | Latched |
| 3. | Water/Backup | CW | CCW | Closed | Released |
| 4. | Water/Normal | CW | CW | Closed | Latched |

In order to move the level valve 450 from its CCW default position to its CW position, level controller 470 (FIG. 11B) applies suction via tube 471 to level flow director 446. The flow director 446 typically comprises a piston (not shown) which responds to applied suction to move from a spring urged default position to an active position. In so doing, the piston pulls a crank arm (not shown) to rotate control member 444 clockwise to thus turn valve 450 clockwise and close flood valve 426. In order to move the direction valve 458 from its CCW default position to its CW position, direction controller 472 (FIG. 11B) applies suction via tube 473 to direction flow director 460. Flow director 460 can be structurally identical to flow director 446 and likewise will rotate its control member 464 clockwise in response to applied suction.

Attention is now directed to FIG. 11B which depicts a preferred controller subsystem 401 including level controller 470 and direction controller 472. The overall function of the controller subsystem of FIG. 11B is to define, i.e., initiate and maintain, the mode/state operating condition of FIG. 11A. The controller subsystem includes a timing assembly driven by drive shaft 474 which normally controls the initiation and duration of the water surface and wall surface cleaning modes and normal and backup states. The subsystem 401 preferably also includes a user override control to enable the user to selectively restrict the operating mode to either water surface or wall surface and a motion sensor to expedite the backup state if the body's forward motion is arrested or impeded, as by an obstruction.

Subsystem 401 of FIG. 11B is coupled to FIG. 11A by aforementioned tubes 471, 473, drive shaft extension 474 and suction tube 475 which is coupled to suction side 439 of pump 440. Subsystem 401 includes level controller 470 which has an inlet 476 coupled to tube 475. The suction available at inlet 476 is either coupled or not coupled to outlet 478 depending on the state of controller 470 which is determined by the rotational position of manual override disk 480 and/or valve disk 482. More particularly, note that override disk 480 defines a peripheral notch 484 and a transfer port 486 arcuately displaced from one another. Either the notch 484 or the port 486 can be selectively aligned with controller port 488 depending upon the rotational position of the disk 480 which a user can manually set using the control lever 489. When the notch 484 is aligned with port 488, then the suction available at inlet 476 pulls ambient pool water into port 488 and is not transferred to outlet 478 (and level flow director 446) regardless of the position of valve disk 482. On the other hand, when transfer port 486 is aligned with port 488, then suction transfer to outlet 478 is determined by the rotational orientation of valve disk 482. The disk 482 is mounted to be rotated by shaft 490 which is driven by drive shaft 474 via a reduction gear train internal to housing 492. As an example, assume that valve disk 482 extends through 180° in order to allocate 50% of the time to the water surface mode and 50% of the time to the wall surface mode. When valve disk 482 covers transfer port 486, then suction at inlet 476 is transferred to outlet port 478 for actuating flow director 446 to close flood valve 426 and move level valve 450 to its CW position. When valve disk 482 is oriented to leave port 488 open, then the level valve 450 and flood valve 426 move to their default positions, i.e., CCW and open. Valve disk 482 is preferably rotated at an essentially constant rate by shaft 490.

Direction controller 472 couples the suction available at its inlet 491 to outlet port 493 only when valve element 494 covers port 495. Valve element 494 is mounted to be rotated by shaft 496 which is driven, via reduction gearing internal to housing 497 by turbine 498. Turbine 498 is driven by water pulled through nozzle 499 by suction at port 500.

Note in FIG. 11B that reduction gear housing 492 carries an external level control timing disk 502 and reduction gear housing 497 carries an external direction control timing disk 504. The disks 502 and 504 are mounted side by side in the same plane. A latch bar 508 is mounted for hinged movement around pin 510 between a latched position bearing against the disks and an unlatched position spaced from the disks. The latch bar 508 carries a paddle 511 such that forward motion of the body through the water acts on paddle portion 511 to urge latch bar 508 toward the latched position against the faces of disks 502 and 504. Disk 502 carries one or more lifter cams 512 on its face. Lifter cam 512 preferably has a ramp at its leading edge 514 configured to engage and lift latch bar 508 to its unlatched position as the disk 502 rotates in the direction of arrow 514.

Disk 504 carries one or more stop elements 516 on its face, each configured to engage latch bar 508 to stall rotation of disk 504 when latch bar 508 is in its latched position. Stop element 516 is oriented relative to valve element 494 such that when the stop element stalls rotation of disk 504, valve element 494 is covering port 495 thus making suction available at port 491. This acts to maintain direction valve 458 in its CW position so that the body remains in the normal (forward) state. Periodically, when lifter cam 512 on disk 502 lifts latch bar 508 to its unlatched position, stop element 516 is able to move past latch bar 508 enabling disk 504 to rotate thus allowing valve element 494 to rotate and open port 495 which moves direction valve 458 to its default CCW position (backup state). Disk 504 will continue to rotate until port 495 closes to again actuate flow director 460 to return to the normal forward state.

The function of paddle 511 is to sense when the forward motion of the cleaner body diminishes below a certain threshold. This may occur, for example, when the body gets trapped by an obstruction, such as the entrance to a built-in pool skimmer. In such an instance, it is generally desirable to promptly cycle the direction controller 472 to the backup state in order to free the cleaner body. As long as the forward motion of the cleaner body is sufficient to press the latch bar 508 with sufficient force to prevent movement of stop element 516 therepast, direction controller 472 will continue to supply suction to outlet 493 to maintain the body in its normal forward state (except for periodic interruption by lifter cam 512, e.g., every two to five minutes). If, however, the forward motion of the body diminishes below a certain threshold, the ramped leading edge of stop element 516 will lift bar 508 allowing disk 504 and shaft 496 to turn. If disk 504 carries only a single stop element 516, this action immediately initiates a controller 472 cycle which moves valve 458 to its CCW position (backup state) and then to its CW position (forward state). However, by using multiple spaced stop elements 516, as shown in FIG. 11B, multiple time delays are effectively introduced in the forward state before the full controller cycle is launched. Thus, if in the interval after the first stop element 516 passes latch bar 508 and prior to a subsequent stop element passing latch bar 508, the cleaner body frees itself and resumes its forward motion, then a subsequent stop element 516 can engage latch bar 508 to defer cycling the controller 472.

It should now be appreciated that the paddle portion 511 responds to forward body motion so that the system can be promptly switched to its backup state when forward motion drops below a predetermined threshold. This construction results in the system switching to the backup state both on a periodic basis determined by level control disk 502 and an as-needed basis when forward motion diminishes below a certain threshold.

Alternatively, the paddle portion can be deleted and a spring incorporated to urge the latch bar to the latched position in order to restrict operation to periodic switching to the backup state.

In the first embodiment (FIGS. 2–10), it was assumed that the traction wheels 42 were all mounted for free, non-driven rotation on their respective axles. Alternatively, as shown in FIG. 11A, one or more of the wheels could be driven to facilitate movement along the wall surface. Note in FIG. 11A that a front traction wheel 520 is driven by gear train 522 from the turbine drive shaft 436. It should be noted that the wheel 520 is depicted as including one or more notches 524 along its periphery to facilitate movement across an obstruction; e.g., a hose laying on the wall surface.

In the operation of the system of FIGS. 11A and 11B, assume initially that the body is in the wall mode/forward mode state. In this state, the level valve 450 will be in its CCW position and the direction valve 458 will be in its CW position. As long as the forward motion of the body is greater than a predetermined threshold, latch bar 508 will be in its latched position thereby preventing rotation of timing disk 504. Thus, the wall mode/forward state will be maintained.

As the level control timing disk 502 rotates, it periodically engages lifter cam 512 against latch bar 508 to release the latch bar and enable direction controller 472 to cycle through its backup state. Rotation of the drive shaft 474, via the reduction gearing in housing 492, turns shaft 490 to in turn rotate valve element 482. As previously mentioned, when valve element 482 is in a position to close port 486, then suction is available at outlet 478 of controller 470 to move the level valve 450 to its CW position to cause the body to rise to the water surface. On the other hand, when the port 486 is not closed by valve element 482, then the level valve 450 remains in its default CCW position to hold the body against the wall surface.

When the water surface mode is defined, the flow generator 454 will discharge a flow past level valve 450 through outlet 456 to produce force components on the body acting to thrust it forwardly and vertically upward. As a consequence, the body will rise nose first meaning that the chamber forward entrance openings 416L, 416R will emerge above the water surface. Inasmuch as the flood valve 426 is closed in the water surface mode, the pump 434 will pull water out of the chambers 404L, 404R and will fill the chambers with air drawn in through openings 416L, 416R. Note in FIG. 11A that the entrance opening 416L to the left chamber 404L is physically located proximate to the right chamber 404R. Similarly, the entrance opening 416R to right chamber 404R is physically located proximate to the left chamber 404L. This cross configuration helps stabilize and level the body at the water surface. That is, if the body rises to the water surface horizontally tilted so that, for example, left chamber 404L rises before right chamber 404R, the fact that the entrance opening 416R to the right chamber is physically located adjacent to the left chamber will enable air to be drawn in to the lower right chamber to more readily achieve balance.

With the body in the water surface mode and the chambers 404L, 404R filled with air, assume now that the controller subsystem 401 switches to the wall surface mode. This action will open the flood valve 426 to allow ambient water to flood into the chambers 404L, 404R via flood valve opening 441. Aforementioned outlets 408L and 408R, respectively containing check valves 410L and 410R, facilitate evacuation of air from the chambers. Water flow into the chambers 404L, 404R modifies the weight/buoyancy characteristic to assist the thrust outflow via outlet 455 to carry the body down to the wall surface.

THIRD EMBODIMENT (FIG. 12)

Figure 12:
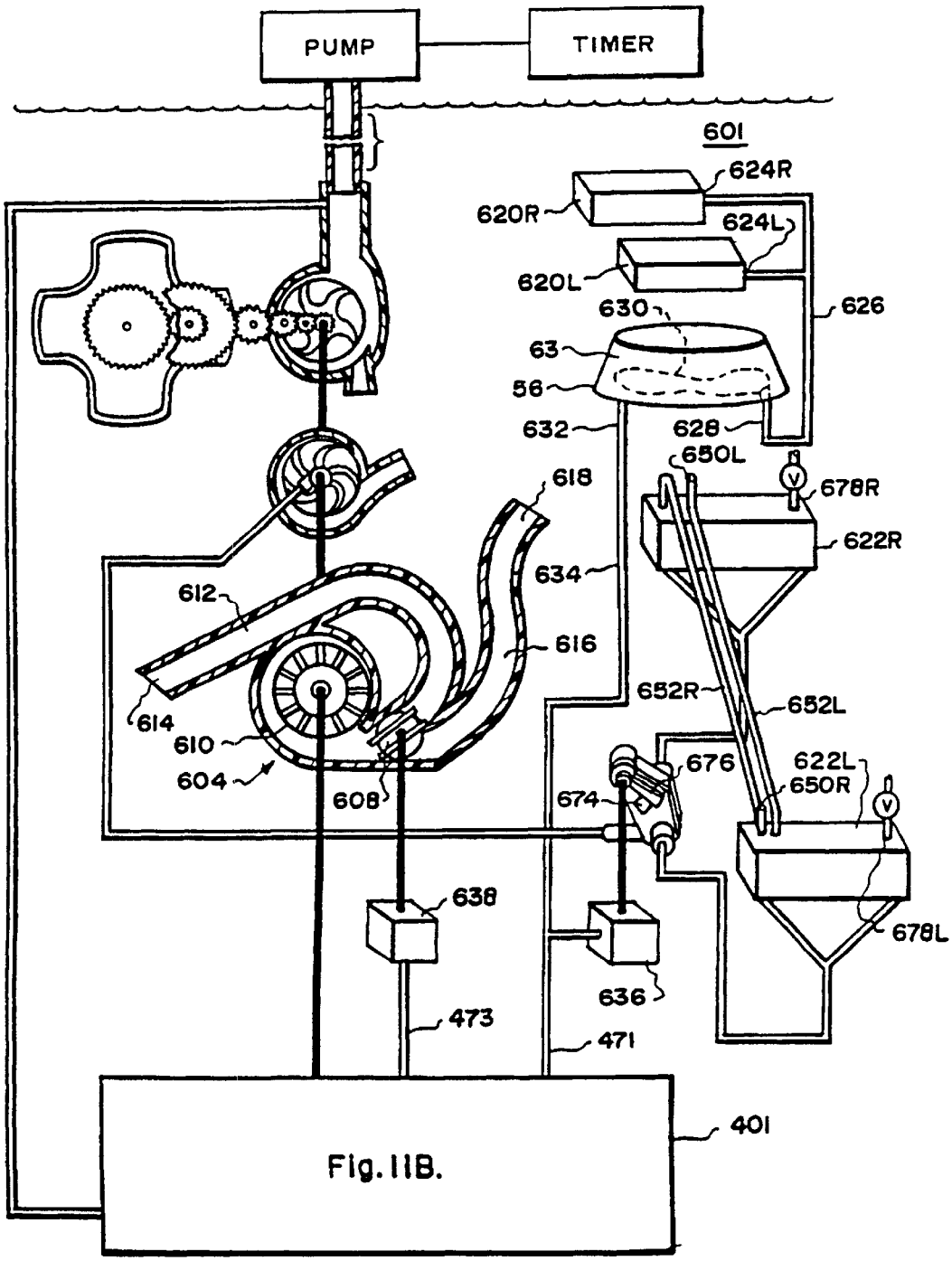
FIG. 12 is an isometric illustration schematically depicting an implementation of water flow distribution in a third embodiment of the invention.

Attention is now directed to FIG. 12 which schematically depicts a third heavier-than-water embodiment 600 of the invention. The embodiment 600 is similar in many respects to the aforediscussed second embodiment 400. It differs, however, primarily in that it does not use a downward vertical discharge to lift the body but instead modifies the body's weight/buoyancy characteristic sufficiently to allow it to float to the water surface. In considering the embodiment 600, initially note that the flow generator housing 604 differs from the housing 452 of FIG. 11A in that level valve 450 and outlet 456 have been deleted. The direction valve 608 remains and in its default CCW position directs a flow created by flow generator 610 along path 612 to backup outlet 614 to discharge a flow forwardly, sidewardly and downwardly. When the direction valve 608 is in its CW position, the flow produced by flow generator 610 is directed along passageway 616 to outlet 618. A discharge through outlet 618 produces a force component acting to move the body forward and a force component acting to hold the traction wheels against the wall surface.

In addition to the modification to the flow generator housing 604, note in FIG. 12 that left and right reservoirs 620L, 620R are shown which in a quiescent state store air (or other gas) at atmospheric pressure. These air reservoirs 620L, 620R are preferably physically mounted within the body's side walls 54L, 54R (FIG. 2) to the rear of the stabilization chambers 622L, 622R. Stabilization chambers 622L, 622R are essentially identical to aforedescribed chambers 404L, 404R. Air reservoirs 620L, 620R have outlets 624L, 624R connected by tubing 626 to the inlet 628 of a flexible impermeable air bag 630, preferably physically contained within the front fin 56 (FIG. 2). The fin interior volume 63 is provided with an outlet 632 which communicates via tube 634 to aforementioned tube 471 of the controller subsystem 401 of FIG. 11B. Level flow director 636 is also coupled to tube 471 as in FIG. 11A. Similarly, the direction flow director 638 is coupled to tube 473 of the controller subsystem 401.

To lift the body from the wall surface to the water surface, the level controller of subsystem 401 applies suction to level flow director 636 via tube 471. This suction pulls water out of fin 56 via tube 634 allowing air from reservoirs 620L, 620R to fill bag 630. By replacing the water in fin 56 with air, the weight/buoyancy characteristic of the body is modified sufficiently to float the body to the water surface. Once the body rises sufficiently to lift openings 650L, 650R above the water surface, then water is evacuated from the stabilization chambers 622R, 622L as air is pulled into the chambers. As previously discussed, the cross configuration of tubes 652L, 652R helps balance and horizontally stabilize the body.

When the controller subsystem 401 switches to the wall surface cleaning mode, suction is removed from tube 471 and instead water from the level controller 470 fills fin 63 via tube 632 thus squeezing bag 630 and compressing the air therein back into reservoirs 620L, 620R. The removal of suction from tube 471 also permits pool water to flood into stabilization chambers 622L, 622R via flood valve inlet 674 past open valve element 676, evacuating air from the chambers via check valves 678L, 678R.

FOURTH EMBODIMENT (FIG. 13)

Figure 13:
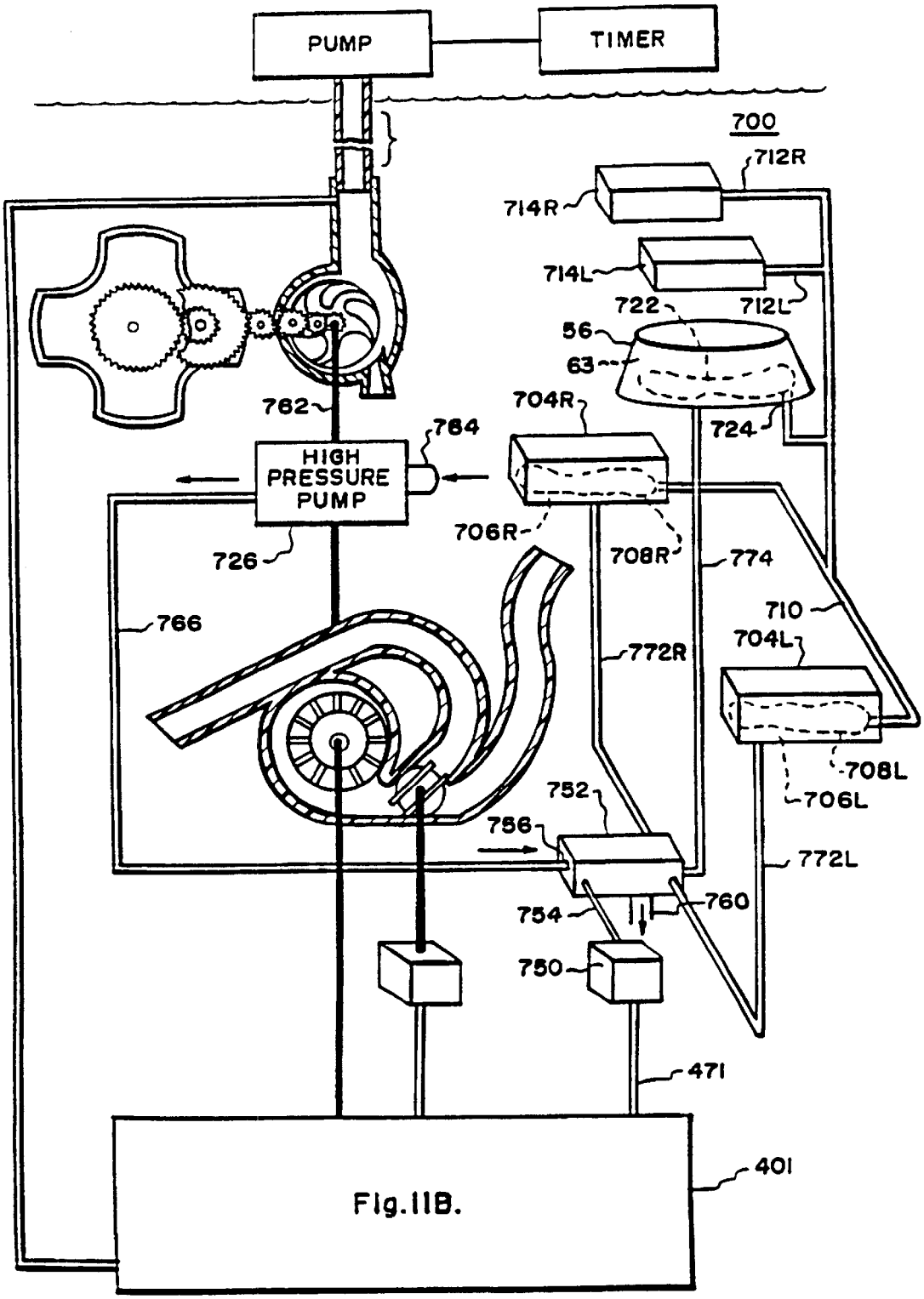
FIG. 13 is an isometric illustration schematically depicting an implementation of water flow distribution in a fourth embodiment of the invention.

Attention is now directed to FIG. 13 which schematically depicts a fourth embodiment 700 of the invention. The embodiment 700 is similar to the embodiment 600 depicted in FIG. 12 except that it is designed so that in its quiescent state it floats at the water surface. In its active state, it is caused to descend to the wall surface. Note that in the embodiment 700, stabilization tanks 704L, 704R define internal volumes 706L, 706R which accommodate flexible impermeable air bags 708L, 708R. The bags 708L, 708R are coupled by tubing 710 to ports 712L, 712R of air reservoirs 714L, 714R, Note also in FIG. 13 that front fin 56 defines interior volume 63 containing flexible impermeable air bag 722. A port 724 of bag 722 communicates via tubing 710 to the ports 712L, 712R of the air reservoirs 714L, 714R.

In the quiescent or default state of the system of FIG. 13, the bags 708L, 708R, and 722 and reservoirs 714R, 714L are all filled with air at atmospheric pressure. As a consequence, the embodiment 700 exhibits a weight/buoyancy characteristic which floats the body at the water surface. In order to cause the body to descend to the wall surface, water from high pressure pump 726 is supplied to the interior volumes 706L, 706R, and 63 to collapse the bags and force the air therefrom back into the reservoirs 714L, 714R. This action occurs in the system of FIG. 13 when the controller subsystem 401 applies suction to tube 471 to actuate actuator 750. Actuator 750 controls valve assembly 752 via control member 754. In a quiescent state, valve assembly 752 is open so that pressurized water supplied by pump 726 to inlet 756 via tube 758 is expelled from drain line 760. Pump 726 is driven by turbine drive shaft 762 to cause it to pull pool water via inlet 764 and discharge it under pressure through tube 766.

When actuator 750 moves valve assembly 752 to its active state, the pressurized water supplied via tube 766 is directed via tubes 772L, 772R, and 774 to the interior volumes of chambers 704L, 704R, and fin 63. This action fills the interior volumes with water, collapsing the bags therein, and modifying the weight/buoyancy characteristic of the body sufficiently to cause the body to descend to the wall surface.

FIFTH EMBODIMENT (FIGS. 14–21)

In the embodiments thus far described (e.g., FIG. 5), a flow generator (e.g., 230, 232) produces a water flow which is discharged through one of the housing outlets (e.g., 240,242,244) dependent upon the rotational position of a direction valve (e.g., 252) and a level valve (e.g., 254). In the fifth embodiment 800 depicted in FIGS. 14–21, instead of using these rotatable valves 252 and 254, the flow generator housing 802 is configured for limited rotational movement to enable its discharge port 804 to selectively communicate with the entrance to any one of the fixedly positioned outlet passageways, i.e., backup outlet 806, wall surface outlet 808, or water surface outlet 810.

Figure 14A:
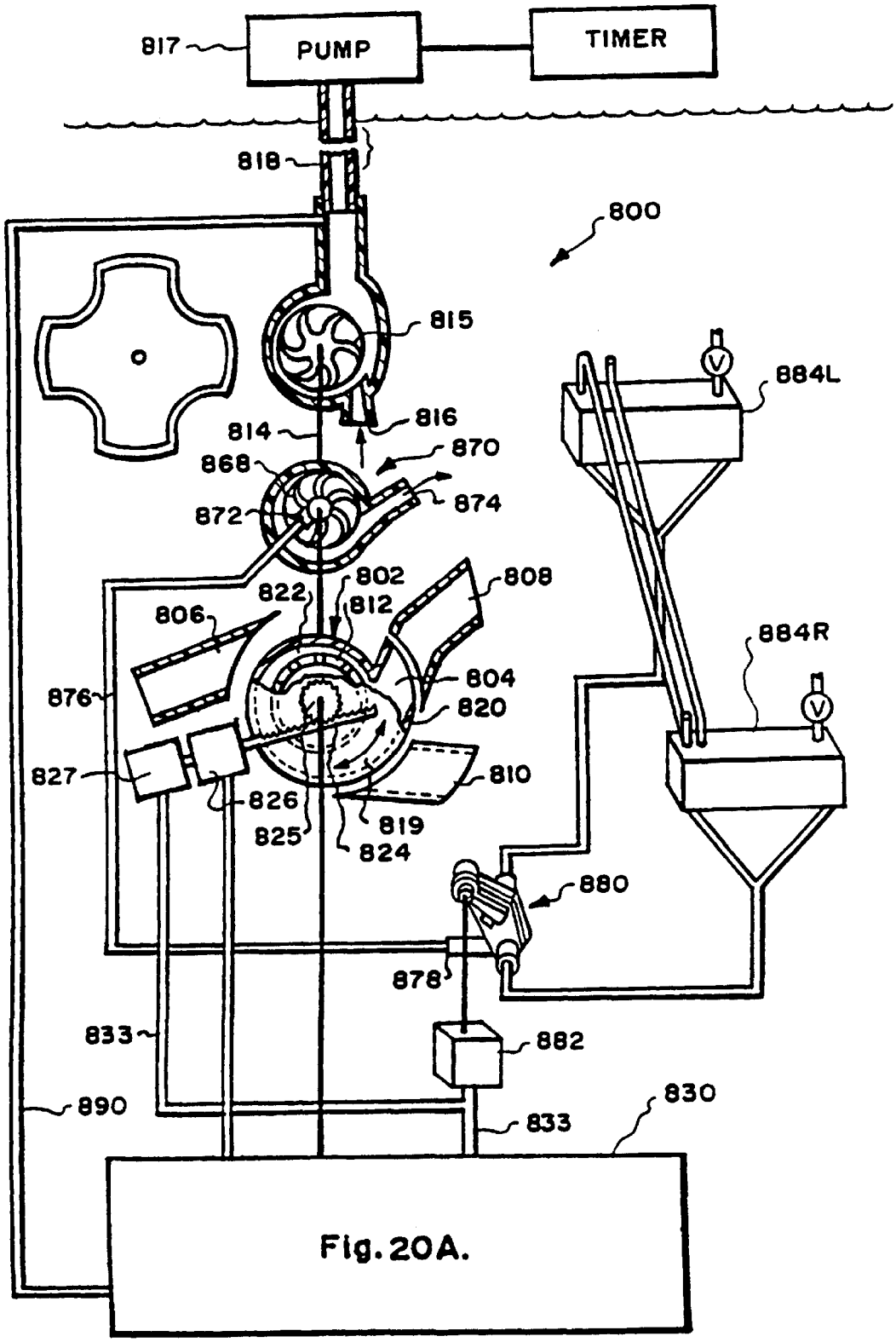
FIG. 14A is an isometric illustration, similar to FIG. 11A, schematically showing water flow distribution in a fifth embodiment of the invention employing a flow generator housing mounted for limited rotation.

More particularly, note in FIG. 14A that paddle wheel flow generator 812 is rotated by drive shaft 814. Drive shaft 814 is driven by main turbine rotor 815 in response to water flow pulled from inlet 816 by pump 817 via suction hose 818. The flow generator 812 is mounted in housing 802 which is comprised of side walls 819 and an arcuate peripheral wall 820 enclosing an internal chamber 822. Arcuate wall 820 defines discharge port 804. As the paddle wheel 812 rotates, it pulls water into its center, preferably from both sides, and discharges the water tangentially along a path defined by the inner surface of wall 820 out through port 804. The housing 802 is mounted for limited rotation to enable the discharge port 804 to be selectively aligned with the entrance to one of the fixedly positioned outlets 806, 808, 810. The housing rotational position is controlled by a rack 824 which is moved linearly to any one of three positions, i.e., left, center, and right, as viewed in FIG. 14A. The rack 824 is engaged with pinion 825 which is affixed to housing 802. When the rack 824 is positioned to the right, as viewed in FIG. 14A, the housing 802 is in its counter-clockwise position with discharge port 804 aligned with backup outlet 806. When the rack is pulled to its center position, housing 802 rotates to a center position to align discharge port 804 with the forward/wall surface outlet 808. When the rack 824 is pulled to its left position, housing 802 is further rotated clockwise to align discharge port 804 with forward/water surface outlet 810.

Figure 14B:
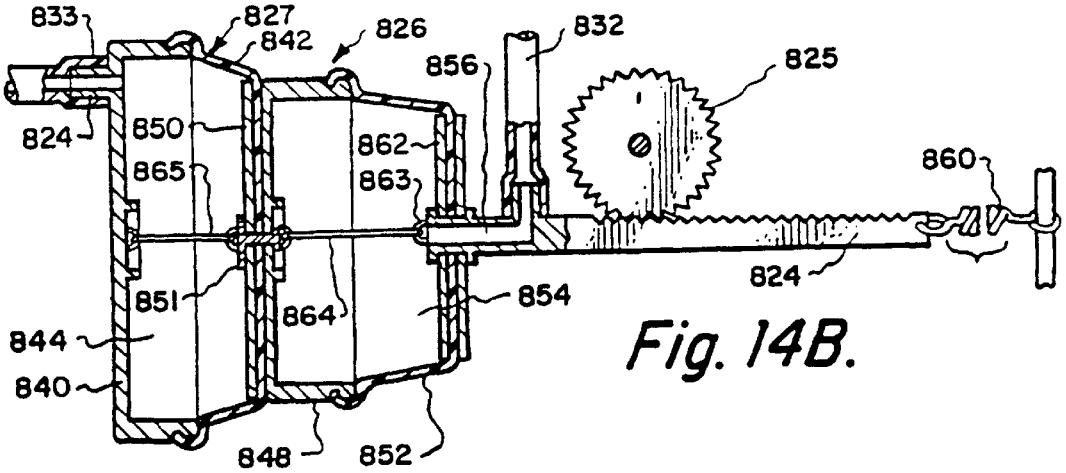
FIG. 14B is an enlarged sectional view showing the rack of FIG. 14A and the state and mode actuators in their default state to position the rack and flow generator housing to define the backup state.
Figure 14C:
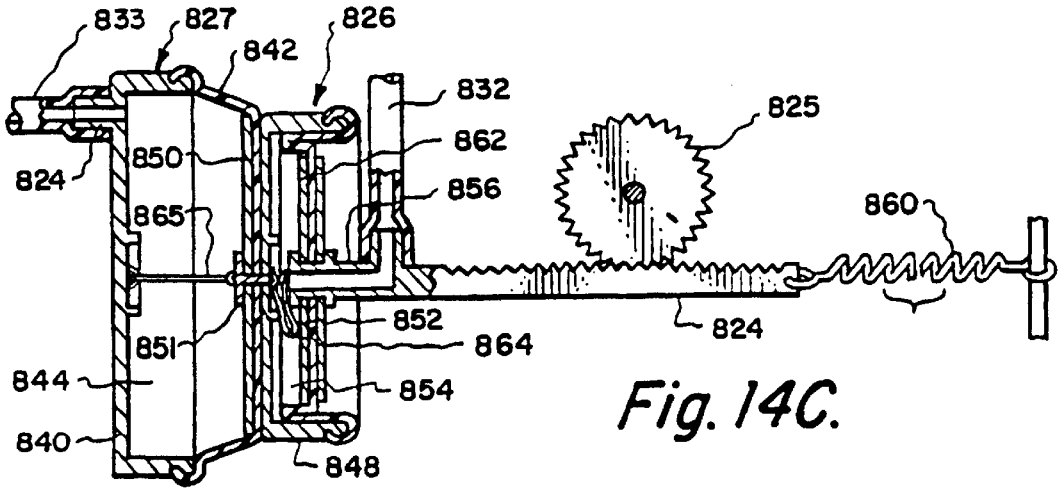
FIG. 14C shows the state actuator collapsed to move the rack to a middle position causing the flow generator housing to rotate to a middle position to define the forward/wall surface state/mode.
Figure 14D:
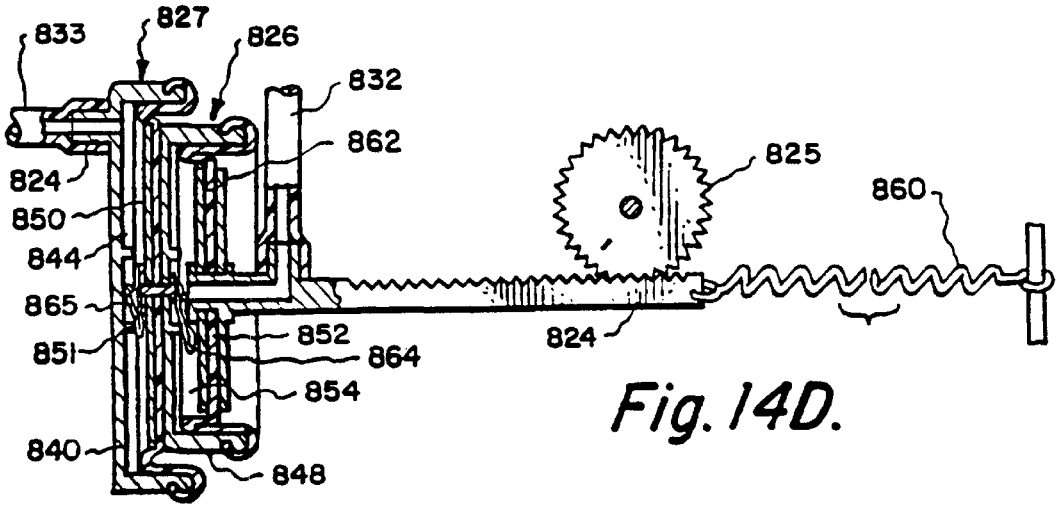
FIG. 14D shows the state and mode actuators both collapsed to rotate the flow generator housing to a CW position to define the forward/water surface state/mode.

The position of the rack 824 is controlled by state actuator 826 and mode actuator 827. The actuators are respectively controlled by controller subsystem 830 via tubes 832 and 833, as will be discussed hereinafter. FIGS. 14B, 14C, and 14D respectively show the condition of the actuators 826 and 827 to selectively position the rack 824 in each of its three possible positions. Initially note in FIG. 14B that the actuator 827 is comprised of a cup-like housing 840 having a diaphragm 842 mounted across its open face. The housing 840 and the diaphragm 842 enclose a chamber 844. The aforementioned tube 833 is coupled to a nipple 846 communicating with the chamber 844. FIG. 14B depicts actuator 827 in its default state when no negative pressure, i.e., suction, is coupled to nipple 846. When suction is applied to evacuate chamber 844, the diaphragm 842 is pulled proximate to the housing 840 floor as is depicted in FIG. 14D.

The actuator 826 is similarly comprised of a cup like housing 848 which is mounted on the actuator 827 diaphragm 842, as by plate 850 and fastener 851. The actuator 826 also includes a diaphragm 852 mounted on the housing 848 to enclose a chamber 854. A nipple 856 extends through the diaphragm 852 and is coupled to the aforementioned tube 832. In its default condition, the chamber 854 is expanded as shown in FIG. 14B. When a negative pressure, i.e., suction, is applied to tube 832, the chamber 854 collapses as is depicted in FIGS. 14C and 14D.

The rack 824 has its right end, as viewed in FIG. 14B, affixed to a spring 860 which normally pulls the rack 824 to the right. The left end of the rack 824 is connected to the diaphragm 852 of the actuator 826 via plate 862 and fastener 863. Thus, the spring 860 biases actuators 826 and 827 to their expanded conditions as depicted in FIG. 14B. Flexible wires 864 and 865 are connected between the respective housings and diaphragms to limit the expansion of actuators 826 and 827.

Figure 17:
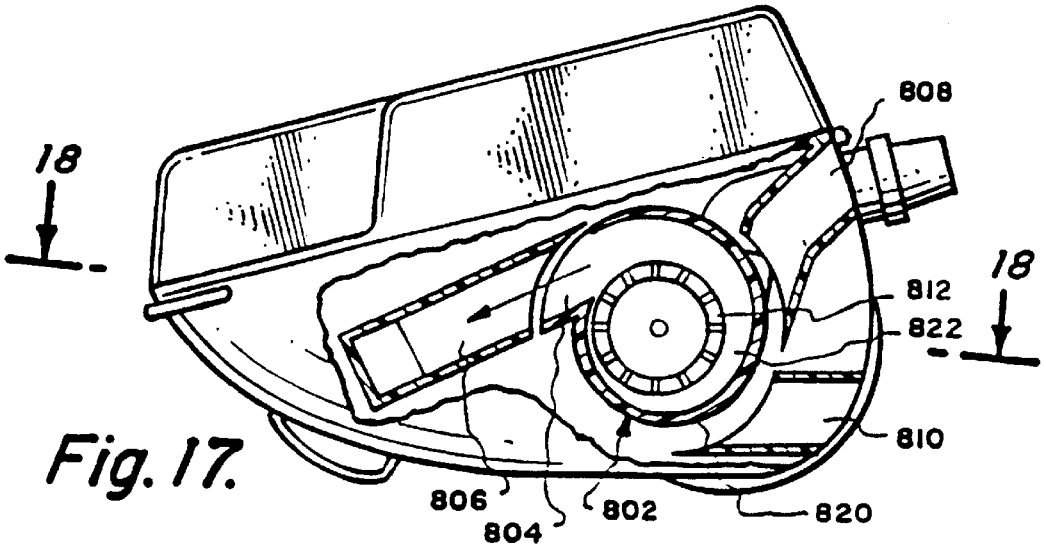
FIG. 17 is a side view similar to FIG. 15 showing attitude and outlet water flow during the backup state.

FIG. 14B depicts the default condition when suction is applied to neither tube 832 or 833. In this default condition, spring 860 pulls rack 824 to the right as depicted in FIG. 14B. This positions the pinion 825 and the housing 802 in its counter-clockwise position aligning discharge port 804 with the backup outlet 806 as shown in FIG. 17. FIG. 14C depicts the application of suction to tube 832 which collapses actuator 826 and pulls the rack 824 to the left against spring 860. The action will rotate pinion 825 and housing 802 clockwise to align discharge port 804 with wall surface outlet 808 as represented in FIG. 15.

FIG. 14D depicts the situation when suction is applied to both tubes 832 and 833 to thus collapse both actuators 826 and 827. The collapse of actuator 827 pulls actuator 826 and rack 824 to its left most position, thus rotating pinion 825 and housing 802 to its clockwise position to move discharge port 804 into alignment with water surface outlet 810 as is represented in FIG. 16.

Figure 15:
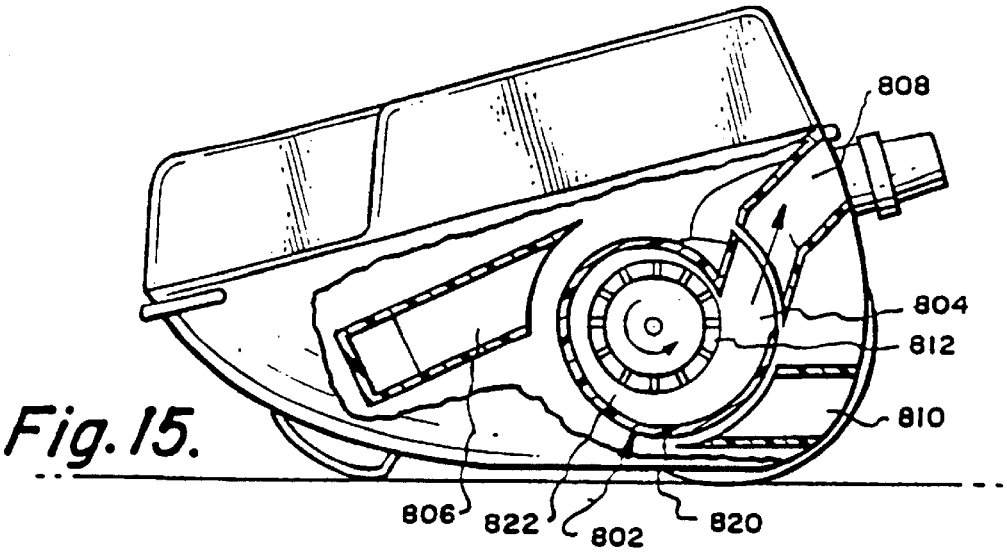
FIG. 15 is a side view of a cleaner body, partially broken away, in accordance with said fifth embodiment showing the body attitude and outlet water flow active during the wall surface cleaning mode.

FIG. 15 is a side view of the cleaner body of the fifth embodiment 800 showing the housing 802 in its center position with port 804 communicating with outlet 808. A water outflow via outlet 808 is in a direction to produce force components acting to hold the body against the wall surface while propelling it therealong during the wall surface cleaning mode. This condition occurs as a consequence of the actuation of actuator 826 as represented in FIG. 14C.

Figure 16:
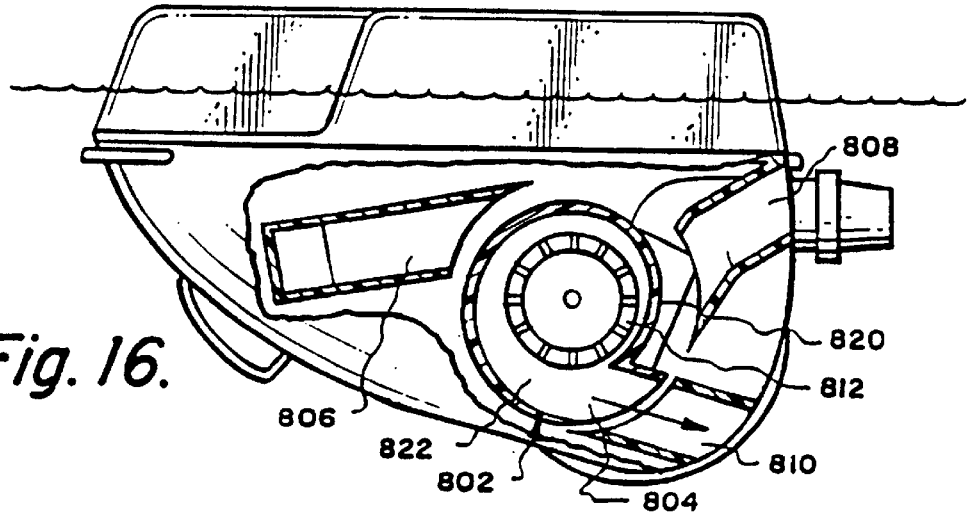
FIG. 16 is a side view similar to FIG. 15 showing attitude and outlet water flow during the water surface cleaning mode.

FIG. 16 depicts the cleaner body in the water surface cleaning mode as a consequence of outflow from outlet 810. This condition occurs as a consequence of the actuation of both actuators 826 and 827 as depicted in FIG. 14D. FIG. 17 depicts the cleaner body in its default condition which is the backup state which occurs as a consequence of the housing 802 aligning port 804 with outlet 806. This condition corresponds to that represented in FIG. 14B.

Figure 18:
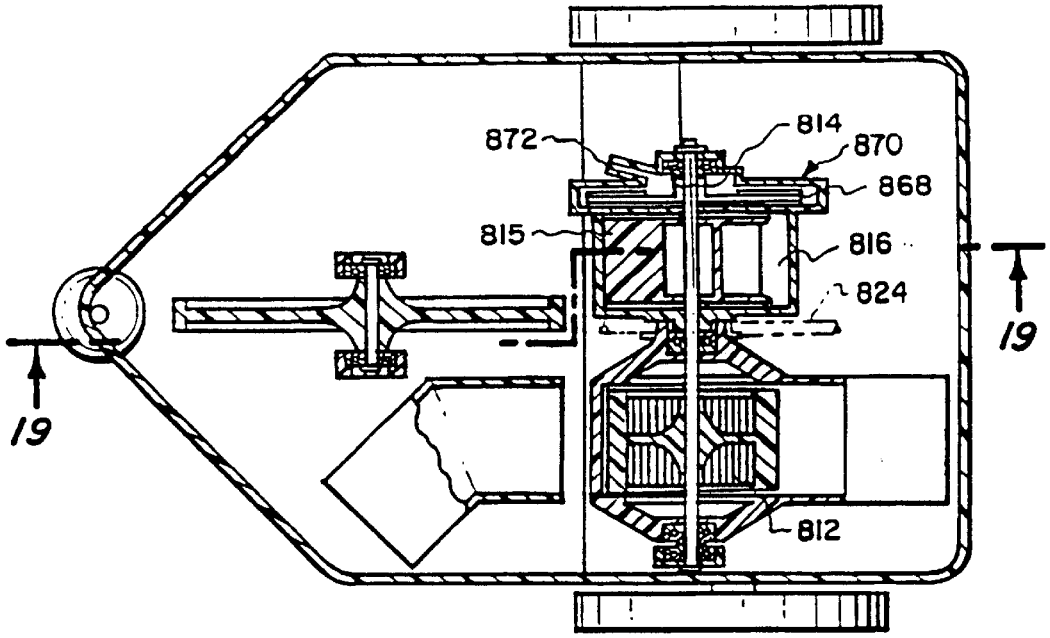
FIG. 18 is a sectional view taken substantially along the plane 18—18 of FIG. 17.
Figure 19:
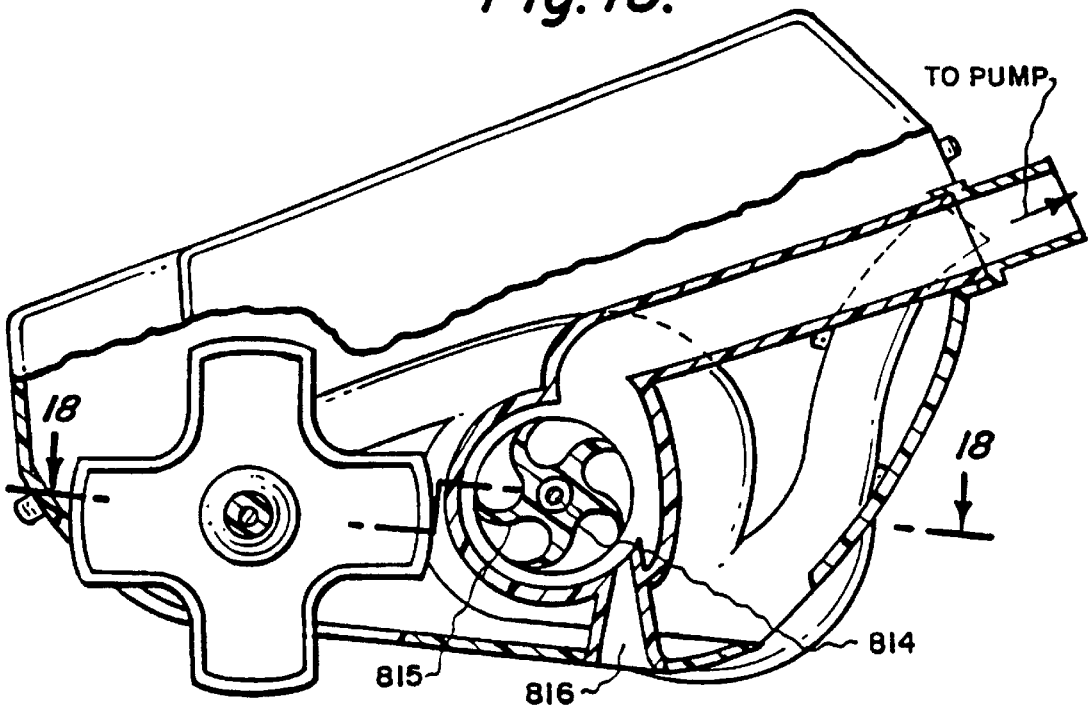
FIG. 19 is a sectional view taken substantially along the plane 19—19 of FIG. 19.

FIG. 18 is a sectional viewtaken substantially along the plane 18—18 of FIG. 17. It shows the main turbine rotor 815 mounted on drive shaft 814. The rotor 815 is driven by water pulled upwardly through entrance 816 to the suction side of pump 817 via hose 818. The drive shaft 814 turns the flow generator paddle wheel 812 to produce the aforediscussed flow for discharge via port 804. Additionally, the drive shaft 814 turns the rotor 868 of centrifugal pump 870 having a suction inlet 872 and a discharge outlet 874. A suction tube 876 is coupled to the suction inlet 872 and extends to a suction outlet 878 of flood valve 880. Flood valve 880 functions identically to flood valve 426 which has previously been discussed in connection with FIG. 11A. It will be recalled that flood valve 426 is controlled by a level flow director 446, analogous to the flow director 882 depicted in FIG. 14A. In the wall surface cleaning mode, the flow director 882 opens the flood valve 880 to allow pool water to flow into chambers 884L and 884R. In the water surface mode, flow director 882 closes flood valve 880 allowing suction tube 876 to pull water out of the chambers 884L and 884R to stabilize the cleaner body at the water surface.

The operation of flow director 882 and actuator 827 is controlled by the controller subsystem 830 via tube 833. The actuator 826 is controlled by the subsystem 830 via the tube 832. It will be recalled from FIGS. 14B, 14C, and 14D that when suction is applied to neither tube 833 or tube 832, the backup state is defined as depicted in FIG. 14B. When suction is applied only to tube 832, the cleaner body operates in the forward/wall surface state/mode as depicted in FIG. 14C. When suction is applied to both tubes 832 and 833, then the cleaner body operates in the forward/water surface state/mode as depicted in FIG. 14D.

Figure 20A:
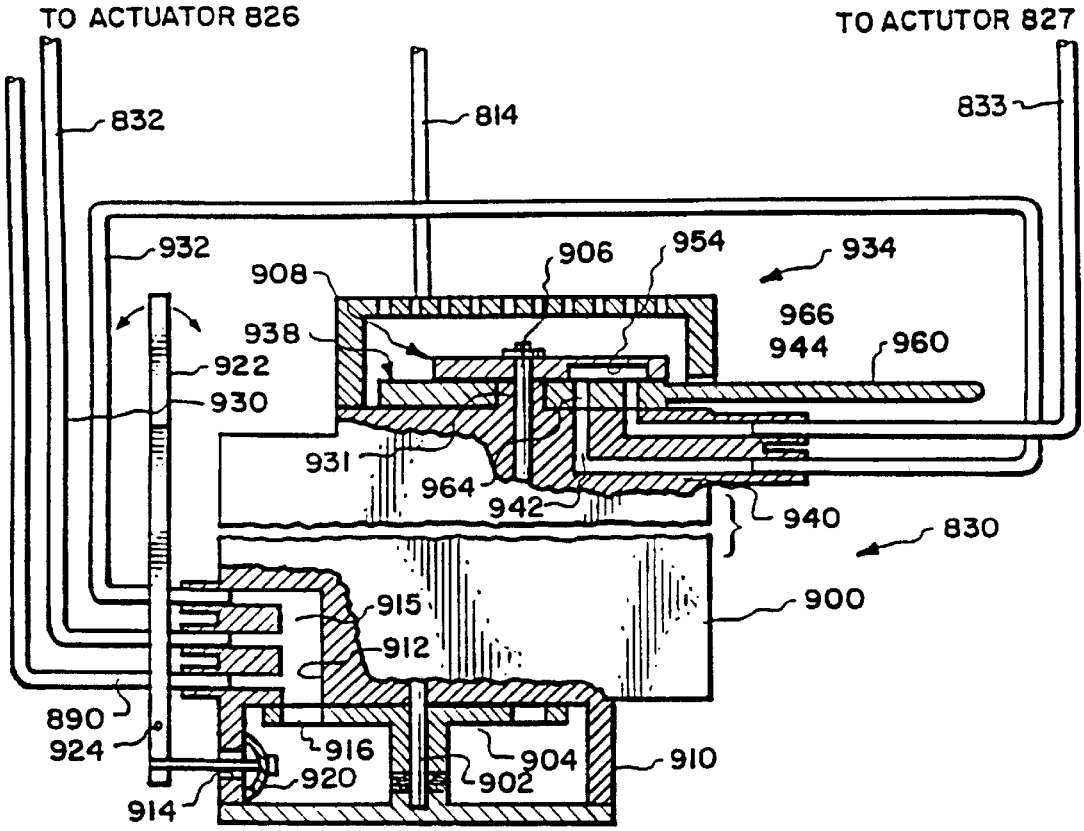
FIG. 20A is a sectional view showing a preferred controller subsystem implementation useful in the system of FIG. 14A.
Figure 20B:
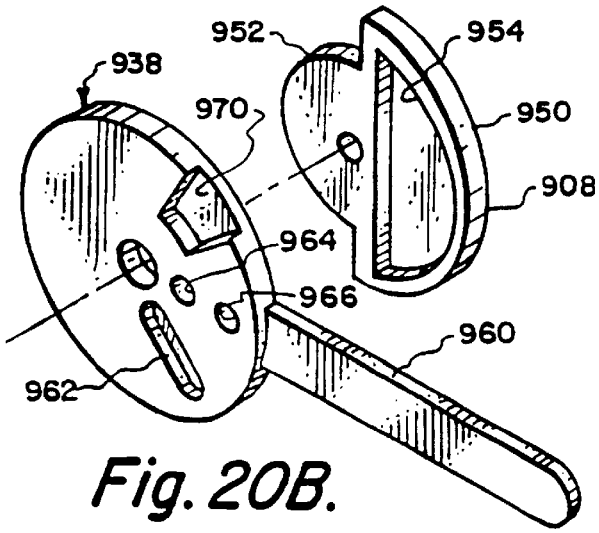
FIG. 20B is an isometric illustration showing the mode and override disks of FIG. 20A.
Figure 20C:
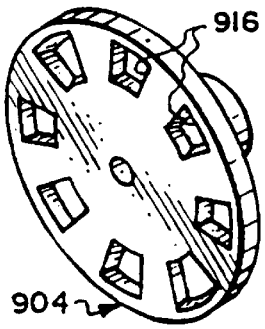
FIG. 20C is an isometric illustration showing the periodic disk of FIG. 20A; and, FIGS. 21A, 21B, 21C and 21D respectively show the orientation of the mode and override disks in the automatic water surface condition, the override water surface condition, the override wall surface condition and the automatic wall surface condition.

Attention is now directed to FIG. 20A which depicts the controller subsystem 830 shown in block form in FIG. 14A. The subsystem 830 is comprised of a gear box housing 900 containing a gear train (not shown) driven by the aforementioned drive shaft 814. The drive shaft 814, via the gear train, drives shaft 902 carrying a periodic disk 904 and drive shaft 906 carrying mode disk 908.

The periodic disk 904 is mounted for rotation in sealed chamber 910 defined by the housing 900. Chamber 910 defines first and second apertures 912 and 914. Aperture 912, which opens to manifold 915, is periodically opened and closed as a consequence of the rotation of the periodic disk 904 by drive shaft 902. Disk 904 defines a plurality of openings 916 arranged along an annular track so that aperture 912 opens chamber 910 to manifold 915.

Aperture 914 communicates chamber 910 with the ambient pool water. The aperture 914 is opened or closed by valve 920 controlled by paddle 922 mounted for movement on pivot pin 924. The paddle 922 is mounted so that when the cleaner body is moving in a forward direction at greater than a threshold rate, the paddle swings clockwise as viewed in FIG. 20A to seat the valve element 920 and close the aperture 914. When the cleaner body forward motion falls below a defined threshold, then the suction available from manifold 915, via an opening 916, unseats valve element 920 to open aperture 914.

If either aperture 912 or aperture 914 is closed, then suction coupled via tube 890 to manifold 915 is transferred to tubes 930 and 932. Tube 930 is coupled to actuator 826 via tube 832. Tube 932 extends to valve assembly 934. Valve assembly 934 selectively couples the suction from tube 932 to tube 833 and actuator 827, dependent upon the orientation of mode disk 908 and override disk 938.

More particularly, note that tube 932 extends through block 940 and terminates at aperture 942. Tube 833 similarly extends through block 940 and terminates at aperture 944. The relative orientation of the mode disk 908 and override disk 938 determine whether or not apertures 942 and 944 communicate.

The mode disk 908 is comprised of a large radial portion 950 and a small radial portion 952. Note that the large radial portion 950 contains a pocket recess 954. The mode disk 908 is rotated by shaft 906.

Figure 21A:
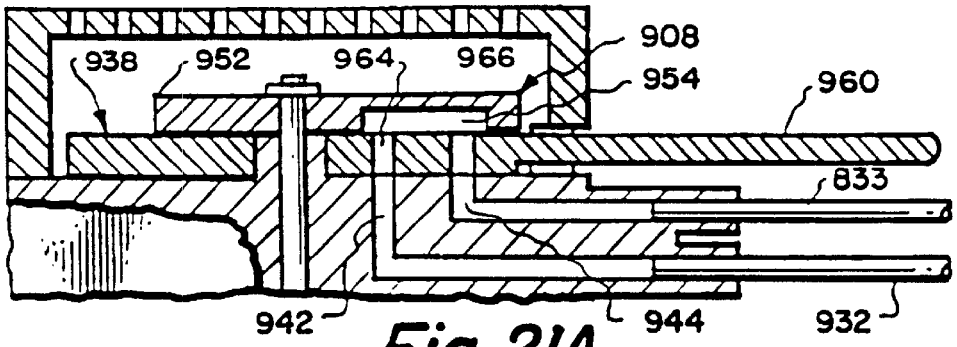
Figure 21B:
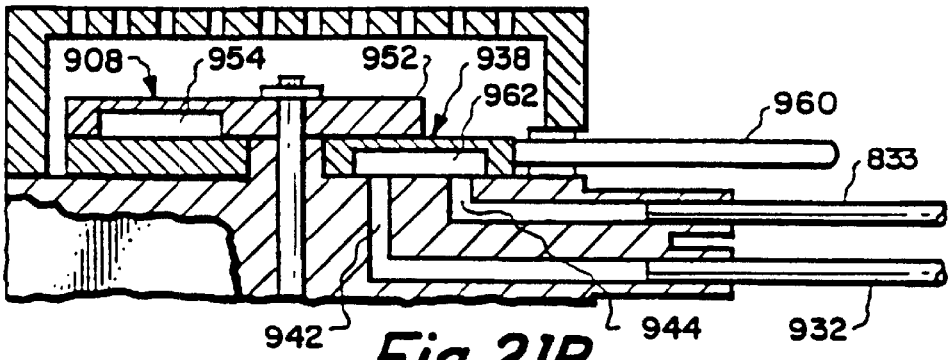

The override disk 938 is provided with a radially extending handle 960 which enables a user to manually rotate the disk around boss 961 relative to the apertures 942 and 944. For a first rotational position of the override disk 938, a radially extending trench 962 is aligned with the s apertures 942 and 944 to assure that they are directly coupled regardless of the position of mode disk 908. This situation is represented in FIG. 21B and assures that the valve assembly 934 transfers suction from the tube 932 to the tube 833 regardless of the position of the mode disk 908. Thus, when the trench 962 is aligned with apertures 942 and 944, the cleaner body will always operate in the water surface mode.

In a second rotational position of the override disk 938, spaced openings 964 and 966 are respectively aligned with apertures 942 and 944. This position of the override disk is represented in FIGS. 21A and 21D. In this position of the override disk the cleaner body operation is determined by the orientation of the mode disk 908. When the mode disk recess 954 overlays the override disk openings 964 and 966, then tubes 932 and 833 are coupled allowing the transfer of suction to actuator 827. This situation is represented in FIG. 21A and produces the condition represented in FIG. 14D to cause the cleaner body to operate at the water surface. As the mode disk 908 rotates to move the small radial portion 952 over the aperture 942, as shown in FIG. 21D, tube 833 will fill with pool water to expand actuator 827 and produce the condition presented in FIG. 14C causing the cleaner body to operate in the wall surface cleaning mode.

Figure 21C:
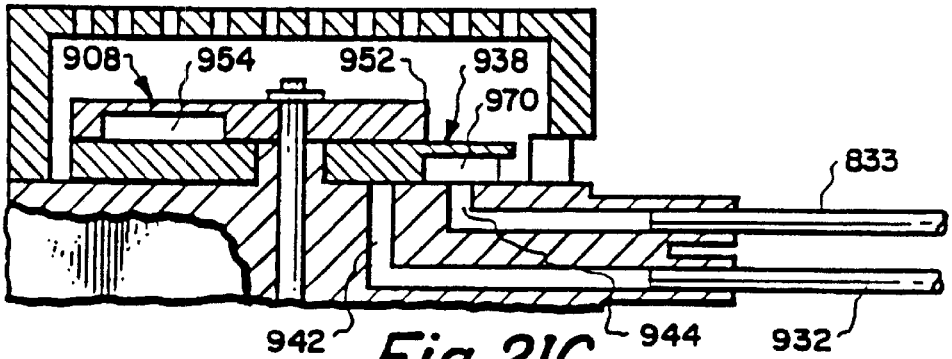
Figure 21D:
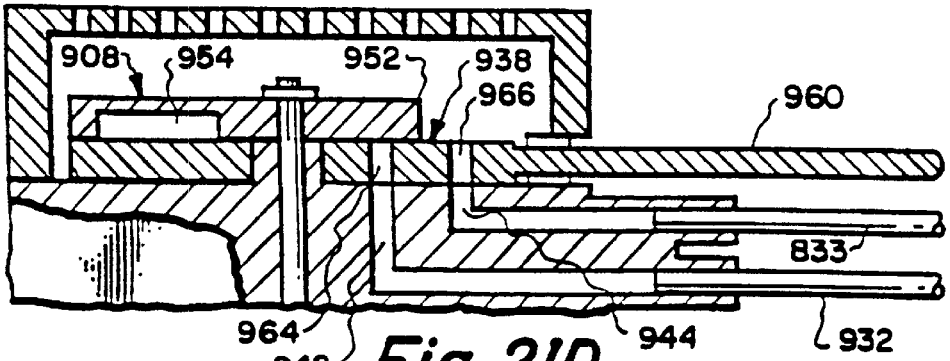

The third position of the override disk 938 is represented in FIG. 21C and places the override disk recess 970 over the aperture 944. As a consequence, regardless of the orientation of the mode disk 908, suction cannot be transferred to the tube 833. Rather tube 833 will fill with pool water and expand actuator 827. Thus, this position of the override disk will restrict operation of the cleaner body to the wall surface mode.

SIXTH EMBODIMENT (FIG. 22)

Figure 22:
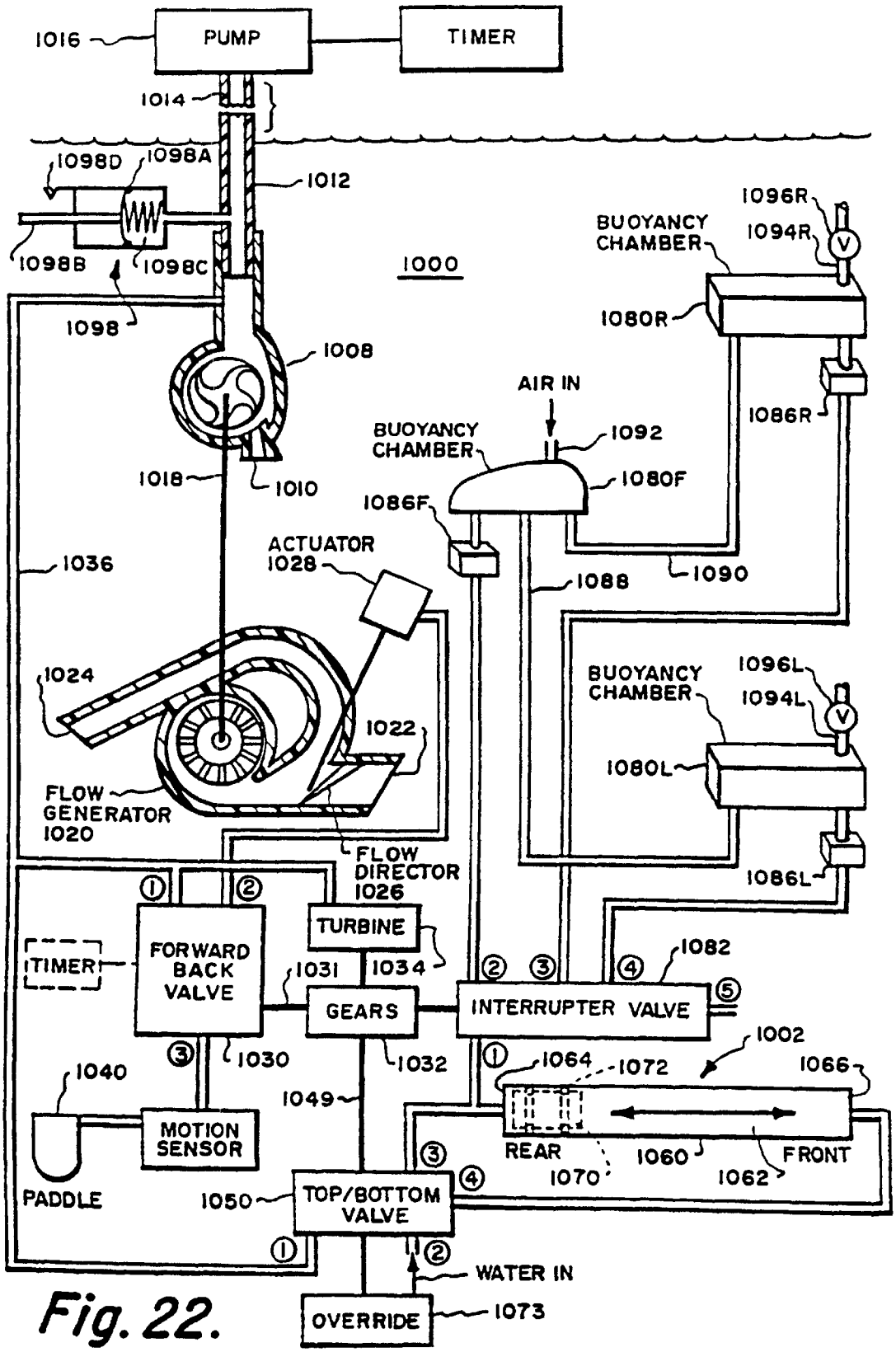
FIG. 22 is a schematic illustration depicting an alternative water flow distribution system incorporating a weight shift subsystem for controlling the pitch of the cleaner body.

Attention is now directed to FIG. 22 which schematically depicts a sixth heavier-than-water embodiment 1000 of the invention. The embodiment 1000 is similar in many respects to the second and third embodiments respectively depicted in FIGS. 11 and 12. It differs primarily in that instead of discharging a vertical flow component (FIG. 11) or modifying the body's weight/buoyancy characteristic (FIG. 12) to move the body from the wall to the water surface, it utilizes a pitch control subsystem 1002. Briefly, the subsystem 1002 selectively orients body pitch to be either nose up/tail down or nose down/tail up. By selectively orienting the pitch of the body and providing forward propulsion, for example, from a single discharge port, the body can be driven either up to the water surface or down to the wall surface.

More particularly, the embodiment 1000 is comprised of a main turbine 1008 driven by pool water drawn through inlet 1010 and coupled via flexible hose 1012 to the suction side 1014 of an electrically driven pump 1016. Turbine 1008 physically drives, via shaft 1018, flow generator 1020 to discharge an outflow from either propulsion port 1022 or redirection port 1024 dependent on the position of hinged flow director valve element 1026. When suction is applied to actuator 1028 to define a forward state, the flow director element 1026 assumes a position to steer the flow produced by generator 1020 to propulsion port 1022. Discharge from port 1022 moves the body in a forward direction. If suction is not applied to actuator 1028, its default state, i.e., redirection (backup), is defined causing the flow director element 1026 to move to a position to steer the flow to redirection port 1024, preferably oriented to discharge in a direction having lateral and rearward components.

Actuator 1028 is controlled by a direction controller, i.e., forward/back valve assembly 1030. Forward/back valve 1030 contains internal valving (not shown) mechanically driven by timing shaft 1031 from gearing 1032 which in turn is driven by supplemental turbine 1034. Tube 1036 couples the suction from pump 1016 to port 1 of the forward/back valve 1030 and to the suction outlet of turbine 1034.

Figure 25A:
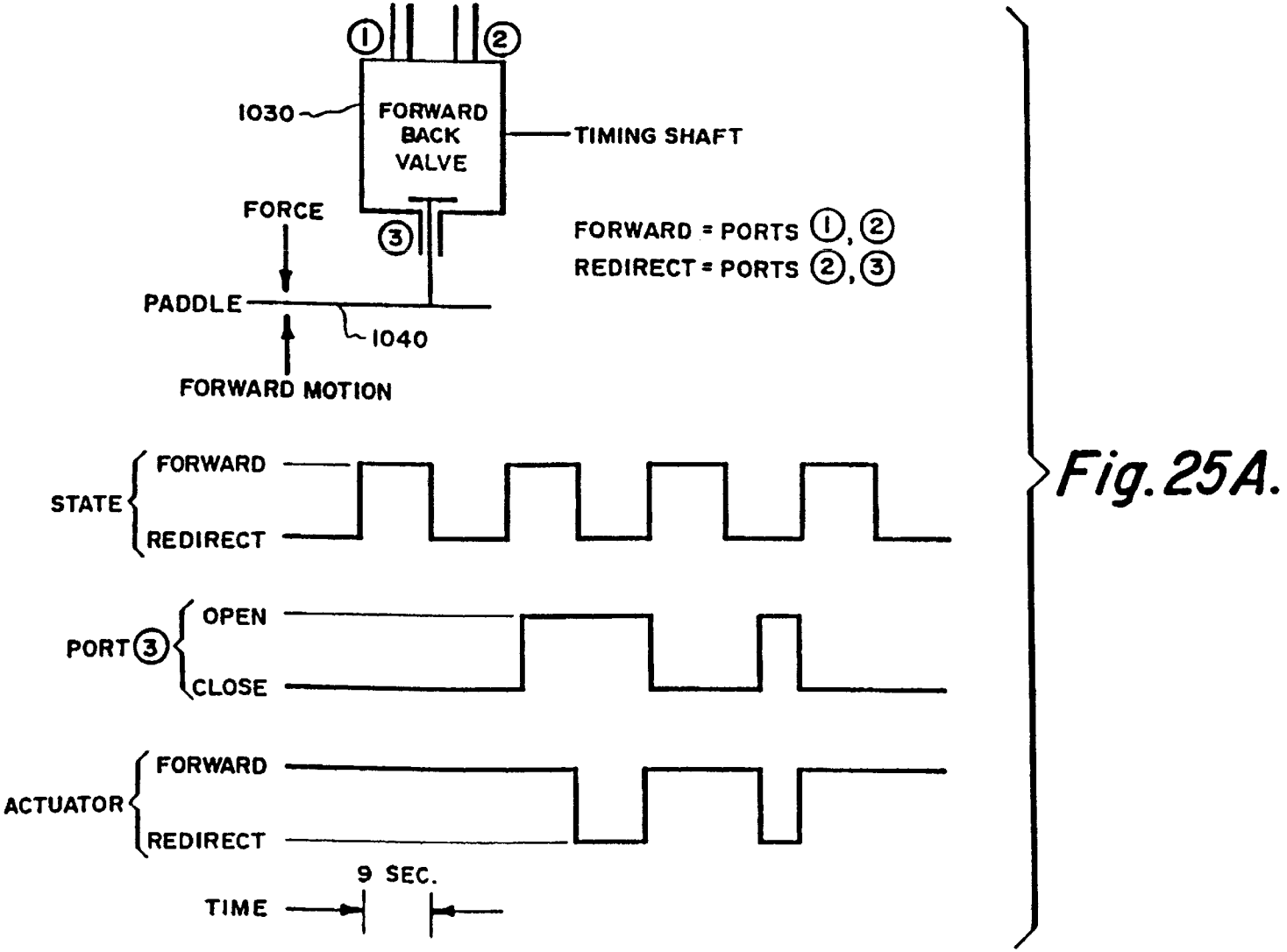
FIGS. 25A, 25B, 25C are block diagram depicting the operation of the various valves of FIG. 22.

As represented in FIG. 25A, the forward/back valve 1030 defines ports 1, 2, and 3. Suction via tube 1036 is always supplied to port 1. Timing shaft 1031 drives valving internal to valve 1030 to periodically define (1) a forward state in which ports 1 and 2 are coupled and port 3 is effectively disabled and (2) a redirection state in which ports 2 and 3 are coupled such that water is available to actuator 1028 only if port 3 is closed. Port 3 is controlled by motion sensor paddle 1040. If the rate of forward motion of the body decreases below a certain threshold, port 3 opens so that during the redirection state, water is supplied to supply water to actuator 1028 to move element 1026 and produce a discharge from redirection port 1024.

Figure 25B:
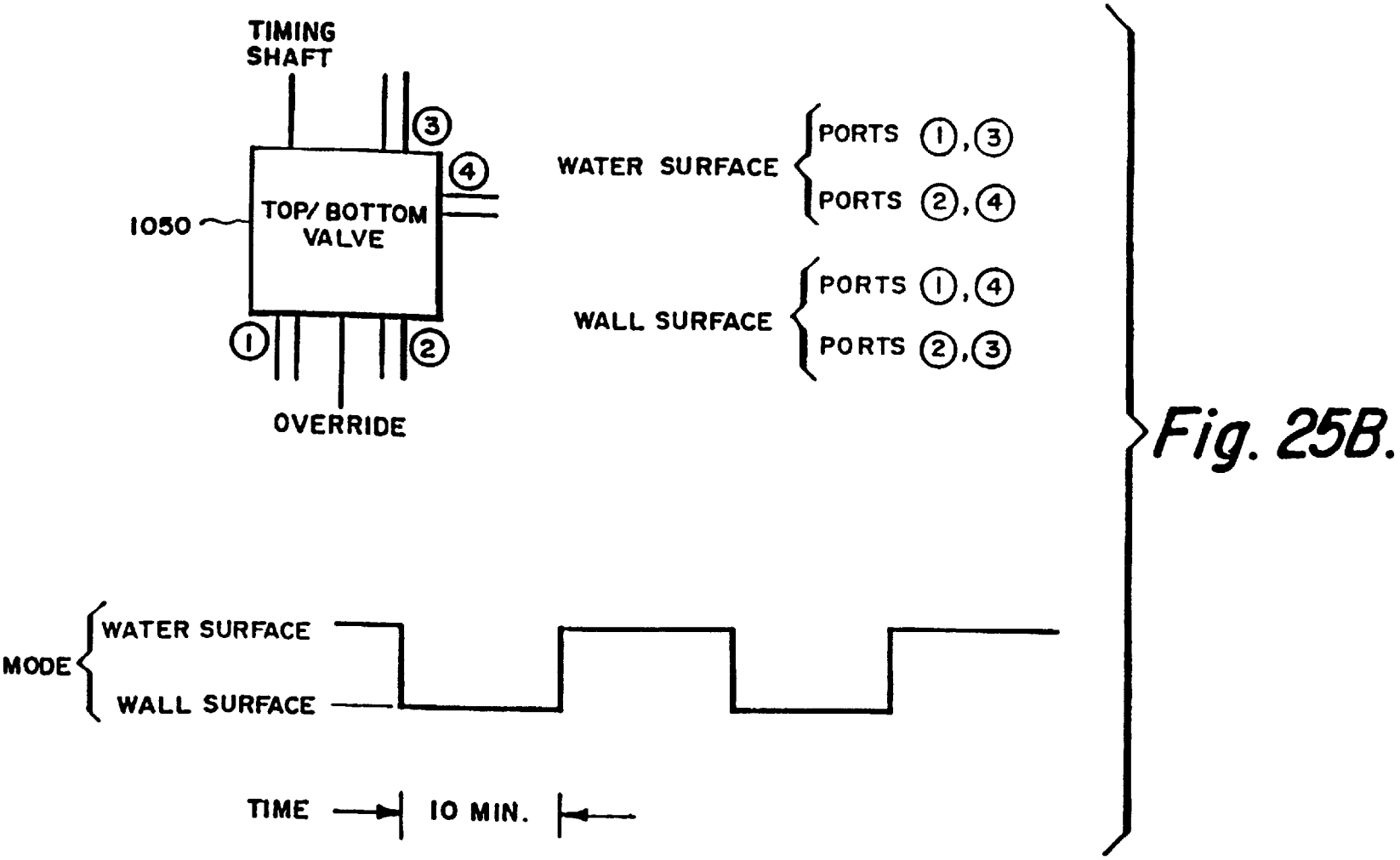

Gearing 1032 via timing shaft 1049 also operates internal valving (not shown) in the level controller or top/bottom valve assembly 1050. Suction via tube 1036 is always supplied to port 1. Port 2 is always open to pool water. The internal valving alternately defines (1) the top or water surface mode and (2) the bottom or wall surface mode, as depicted in FIG. 25B. When the water surface mode is defined, ports 1 and 3 are coupled to make suction available at port 3. When the wall surface mode is defined, ports 1 and 4 are coupled to make suction available at port 4. Ports 3 and 4 of valve 1050 are respectively coupled to opposite ends of tube 1060 of pitch control subsystem 1002. The tube 1060 defines an elongate interior volume 1062 and end fittings 1064 and 1066 respectively coupling opposite ends of the elongate volume 1062 to outlet ports 3 and 4 of valve 1050.

The tube 1060 contains a weighted member 1070 bearing ring seals 1072. The member 1070 is configured to slide in the elongate volume 1062 from one end to the other with the ring seals 1072 engaging and sealing against the tube interior wall surface. The tube 1060 is mounted Qn the body 6 extending in the longitudinal direction from front to rear as depicted in FIGS. 23, 24.

Fitting 1064 is coupled to port 3 of valve 1050 which supplies a negative pressure (i.e., suction) when the water surface cleaning mode is defined by valve 1050. As a result, weighted member 1070 is drawn along tube 1060 toward the rear of body 6 to orient body 6 as shown in FIG. 24 in the nose up pitch orientation.

Figure 23:
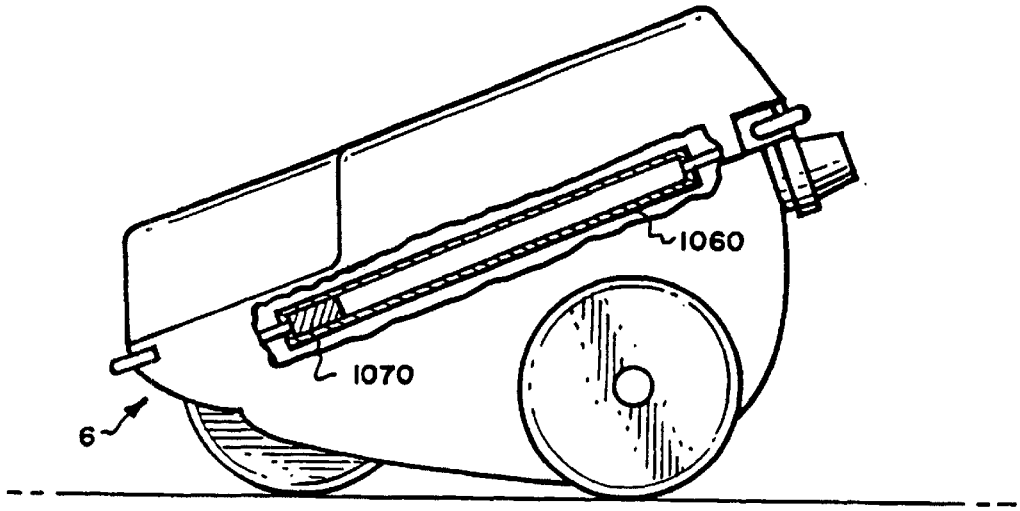
FIG. 23 and 24 respectively depict the body pitch in (1) a nose down/tail up orientation and (2) a nose up/tail down orientation.
Figure 24:
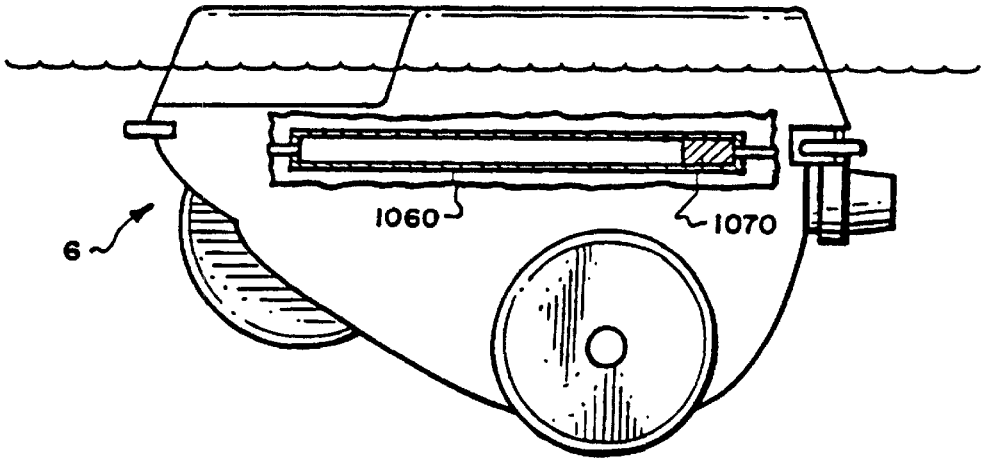

Fitting 1066 is coupled to port 4 of valve 1050 which supplies a negative pressure when the wall surface cleaning mode is defined to draw weighted member 1070 toward the front of body 6 to orient body 6 as shown in FIG. 23 in the nose down pitch orientation.

The discharge from flow generator port 1022 provides propulsion thrust when forward/back valve 1030 defines the forward state. If the body is oriented nose up, the thrust provided by port 1022 will drive the body 6 to the water surface. If the body is oriented nose down, the thrust will drive the body to the wall surface.

An override control 1073 is coupled to the valve 1050 to enable a user to manually establish the level mode (i.e., water surface or wall surface) by overriding the influence of timing shaft 1049.

Left, right, and front buoyancy chambers 1080L, 1080R, and 1080F are carried by the body to stabilize the body at the water surface. Briefly, when body 6 is at the water surface, the chambers 1080L, 1080R, 1080F are filled with air. When the body is submerged, these chambers fill with pool water. In order to cause this action, port 3 of the top/bottom valve assembly 1050 is connected to port 1 of an interrupter valve assembly 1082.

Figure 25C:
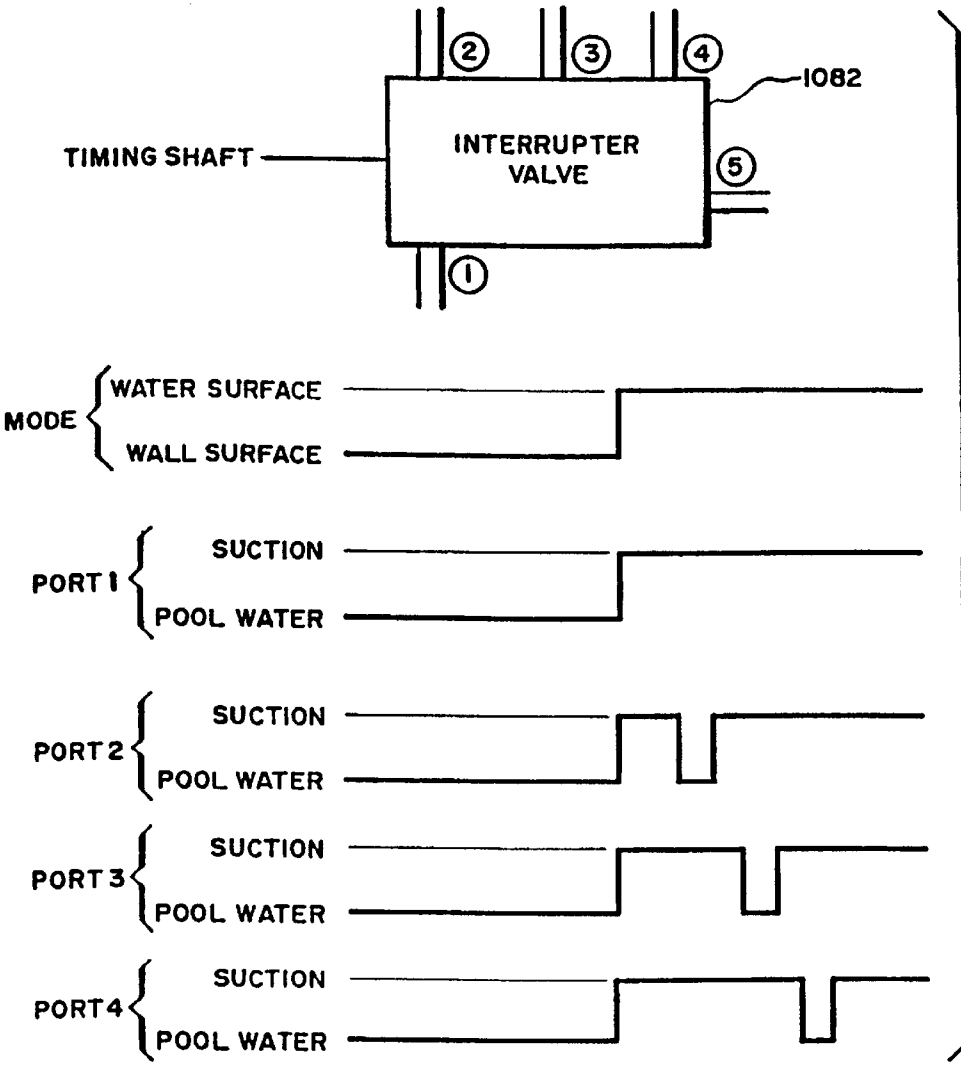

It will be recalled that port 3 of top/bottom valve 1050 supplies negative pressure only when the water surface mode is defined. Otherwise, it is open to pool water via port 2. Thus, interrupter valve port 1 sees suction when the water surface mode is defined and otherwise is open to pool water. Interrupter valve ports 2, 3, and 4 are typically coupled to interrupter valve port 1. However, when the water surface mode is defined, suction to interrupter valve ports 2, 3, and 4 is periodically interrupted, preferably in sequence, by internal valving (not shown) driven by gearing 1032, as depicted in FIG. 25C. Interrupter valve ports 2, 3, and 4 are respectively coupled via air-stop valves 1086F, 1086R, 1086L to bottom ports in chambers 1080F, 1080R, 1080L. Tubes 1088 and 1090 couple bottom ports in chamber 1080F to bottom ports in chambers 1080R and 1080L, respectively. Top port 1092 is provided in chamber 1080F for permitting air to be drawn in when body 6 reaches the water surface and for permitting air to be expelled therefrom when chamber 1080F is flooded with pool water via air-stop valve 1086F. Top ports 1094L and 1094R in chambers 1080L and 1080R couple to check valves 1096L and 1096R for permitting air flow to be expelled out of the chambers.

In operation, when switching from the wall surface to the water surface mode, suction applied to the interrupter valve ports 2, 3, and 4 will draw water from the chambers via air-stop valves 1086F, 1086R, and 1086L. As the body moves to the water surface, front chamber top port 1092 will reach air first enabling air to be pulled into the chamber 1080F, while water is still being sucked via air-stop valve 1086F. The air-stop valves are preferably comprised of a ball which floats above a valve seat as long as water is present. When there is insufficient water to float the ball, it will seal against the valve seat and prevent the introduction of air into the interrupter valve ports 2, 3, and 4.

As air fills front chamber 1080F, air will be supplied, via tubes 1088 and 1090, to chambers 1080R and 1080L while water is being pulled therefrom via air-stop valves 1086R and 1086L. Shortly thereafter, all three chambers will be filled with air to stabilize the body at the water surface. As previously mentioned, interrupter valve 1082 periodically breaks the suction to the air-stop valves 1086 as depicted in FIG. 25C to free the balls therein to maximize water evacuation from the chambers.

When operation switches to the wall surface mode, suction is no longer applied to interrupter valve ports 2, 3, and 4. Instead these ports open to pool water which floods chambers 1080F, 1080R, and 1080L via air-stop valves 1086F, 1086R, and 1086L. As water moves into these chambers, air is expelled via top ports 1092, 1094R, and 1094L. With the chambers filled with water, the body 6 can descend for operation at the wall surface.

In order to enhance reliable operation of the system of FIG. 22, it is preferable to include a suction indicator 1098 on the cleaner body to visually indicated to a user whether sufficient suction is available at main turbine 1008 to properly operate the system. The indicator is comprised of a housing containing a spring urged diaphragm 1098A carrying an indicator pin 1098B. The diaphragm and housing together define a chamber 1098C which is coupled to the water distribution system (FIG. 22) near the outlet of the turbine 1008. The suction in chamber 1098C against diaphragm 1098A establishes the position of indicator pin 1098B relative to a fixed index marker 1098D. This relative positioning indicates to a user whether or not the magnitude of the supplied negative pressure is within the appropriate operating range for the unit.

Figure 26:
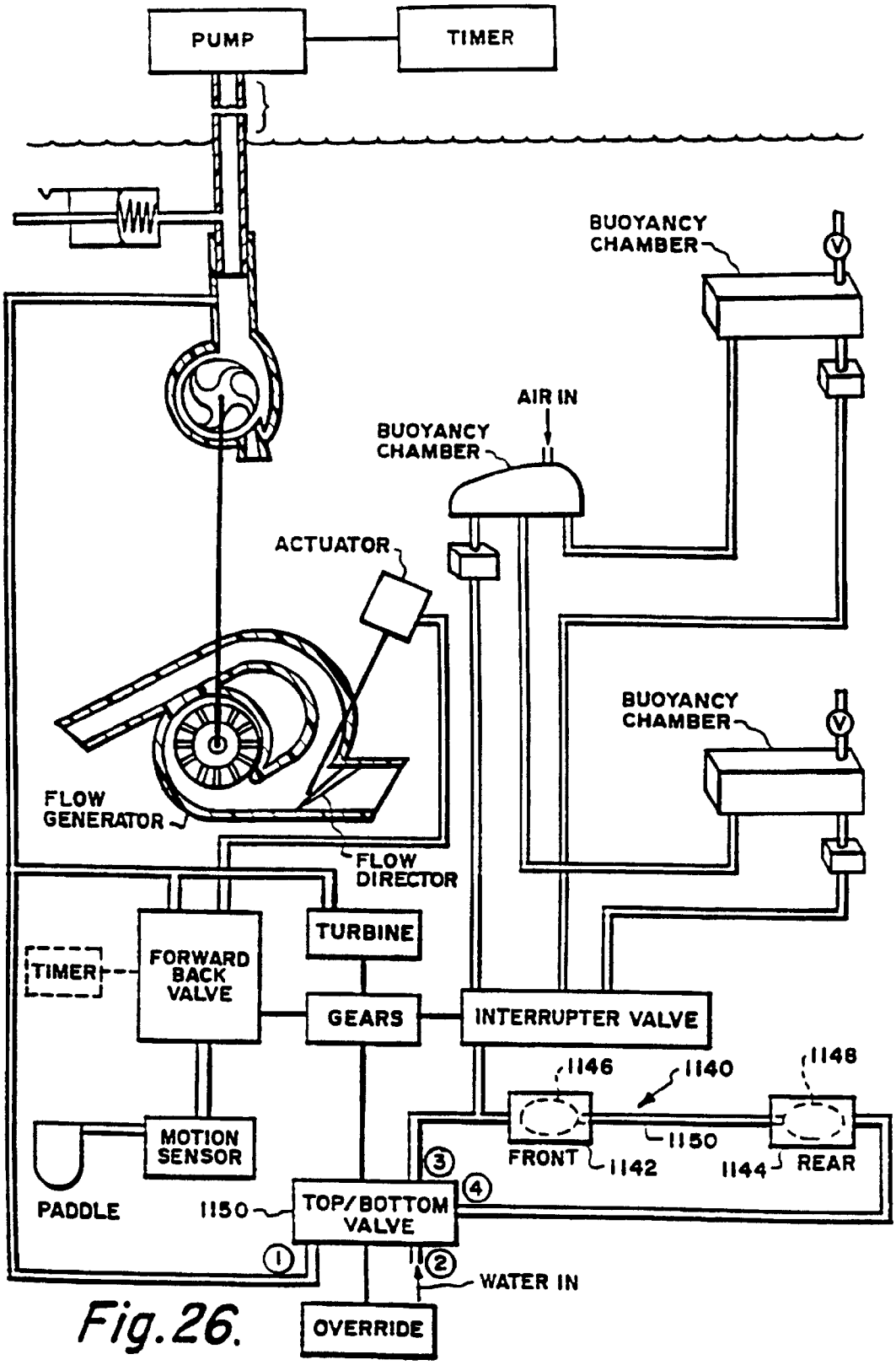
FIG. 26 is a schematic illustration depicting a system similar to FIG. 22 but showing a buoyancy shift subsystem for controlling body pitch.

FIG. 26 depicts a functional block diagram identical to FIG. 22 except that it uses buoyancy shift pitch control rather than weight shift pitch control used in FIG. 22. More particularly, FIG. 26 shows a buoyancy shift pitch control subsystem 1140 comprised of chambers 1142 and 1144 respectively containing flaccid bags 1146 and 1148. An air tube 1150 couples the bags 1146 and 1148 which together contain sufficient air to fully distend one of the bags.

The chambers 1142 and 1144 are respectively coupled to ports 3 and 4 of top/bottom valve 1150 (identical to previously discussed valve assembly 1050). When port 3 supplies a negative pressure, it acts to evacuate chamber 1142 causing air transfer from bag 1148 to bag 1146 located at the front of body 6. This increases the buoyancy of the body front end and consequently orients the body nose up. On the other hand, when port 4 supplies a negative pressure, chamber 1144 is evacuated causing air transfer from bag 1146 to bag 1148. This increases the relative buoyancy of the body rear end to place it in a nose down pitch.

Figure 27:
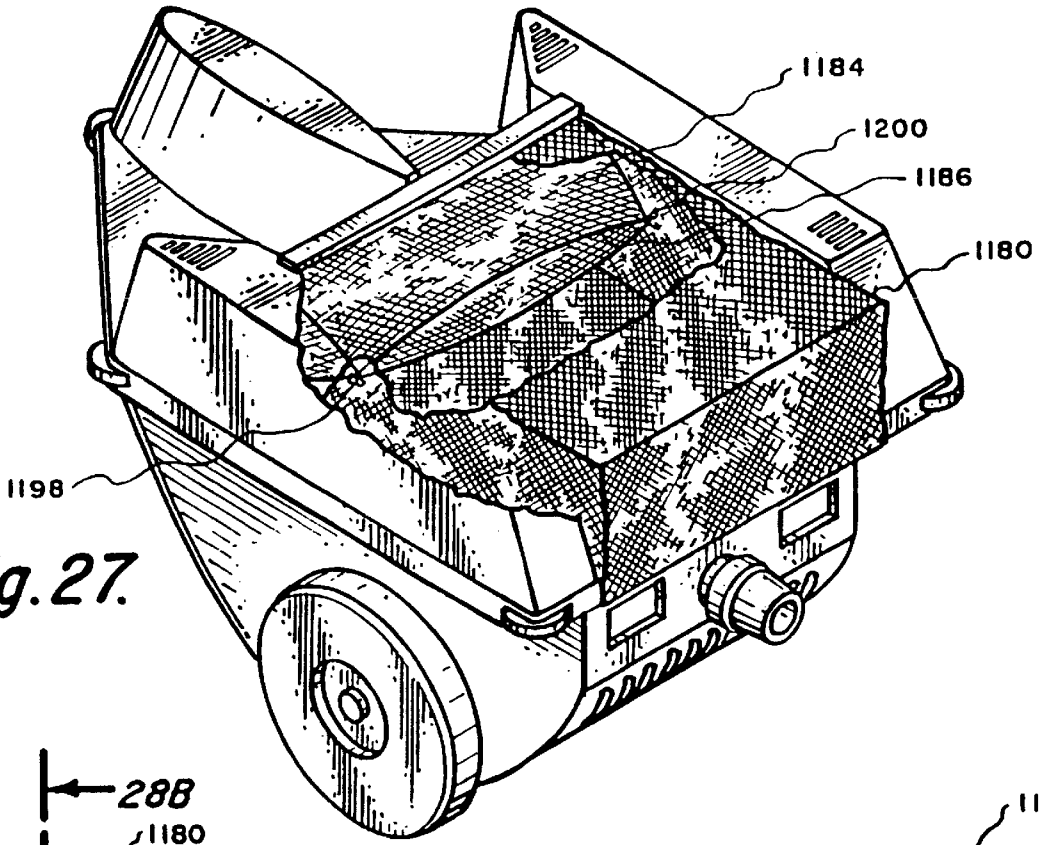
FIG. 27 is an isometric view of a preferred debris bag showing sheets in the bag for permitting debris inflow but blocking debris outflow.

Attention is now directed to FIG. 27 which depicts an enhanced debris container 1180 formed of a flexible water permeable, preferably mesh, material. The container or bag 1180 defines an entrance opening 1182 for passing water borne debris into the bag which typically occurs when the body is operating in the forward state. In order to block debris from exiting the bag when in the redirection or backup state, one or more flexible baffle sheets is mounted in the bag proximate to the bag opening 1182.

Figure 28C:
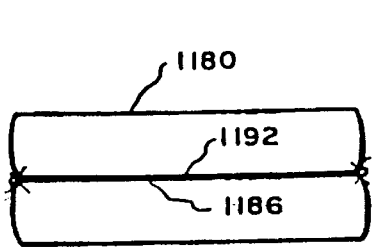
FIG. 28C is a view identical to FIG. 28B but showing the sheet edges closed to block debris outflow.
Figure 28B:
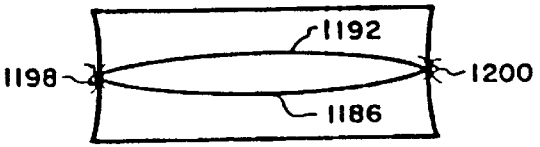
FIG. 28B is a schematic sectional representation taken along line 28B—28B of FIG. 28A.
Figure 28A:
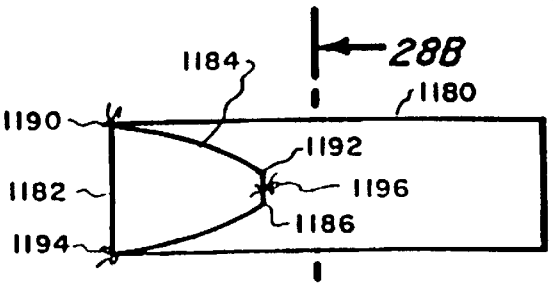
FIG. 28A is a schematic side representation of the debris bag showing its interior sheets open to permit debris entry.

More particularly, FIGS. 27 and 28A show first and second baffle sheets 1184 and 1186, each depicted as being substantially rectangular. Sheet 1184 defines upstream edge 1190 and downstream edge 1192. Sheet 1186 defines upstream edge 1194 and downstream edge 1196. Upstream edges 1190 and 1194 are secured along their lengths to bag 1180 adjacent to opening 1180. The corners of downstream edges 1192 and 1196 are secured to the bag sides at 1198 and 1200.

In the forward state, water and debris flow into the bag from opening 1182 between sheets 1184 and 1186 and act to separate the downstream edges 1192 and 1196 as shown in FIG. 28B, allowing debris to move therepast. When the redirection state is defined to move the body laterally and/or rearwardly through the water, water may tend to move through the bag toward the opening 1182. This action causes the edges 1192 and 1194 to close, i.e., move adjacent to one another, to effectively block debris from exiting from the bag opening 1182.

SEVENTH EMBODIMENT (FIG. 29)

Figure 29A:
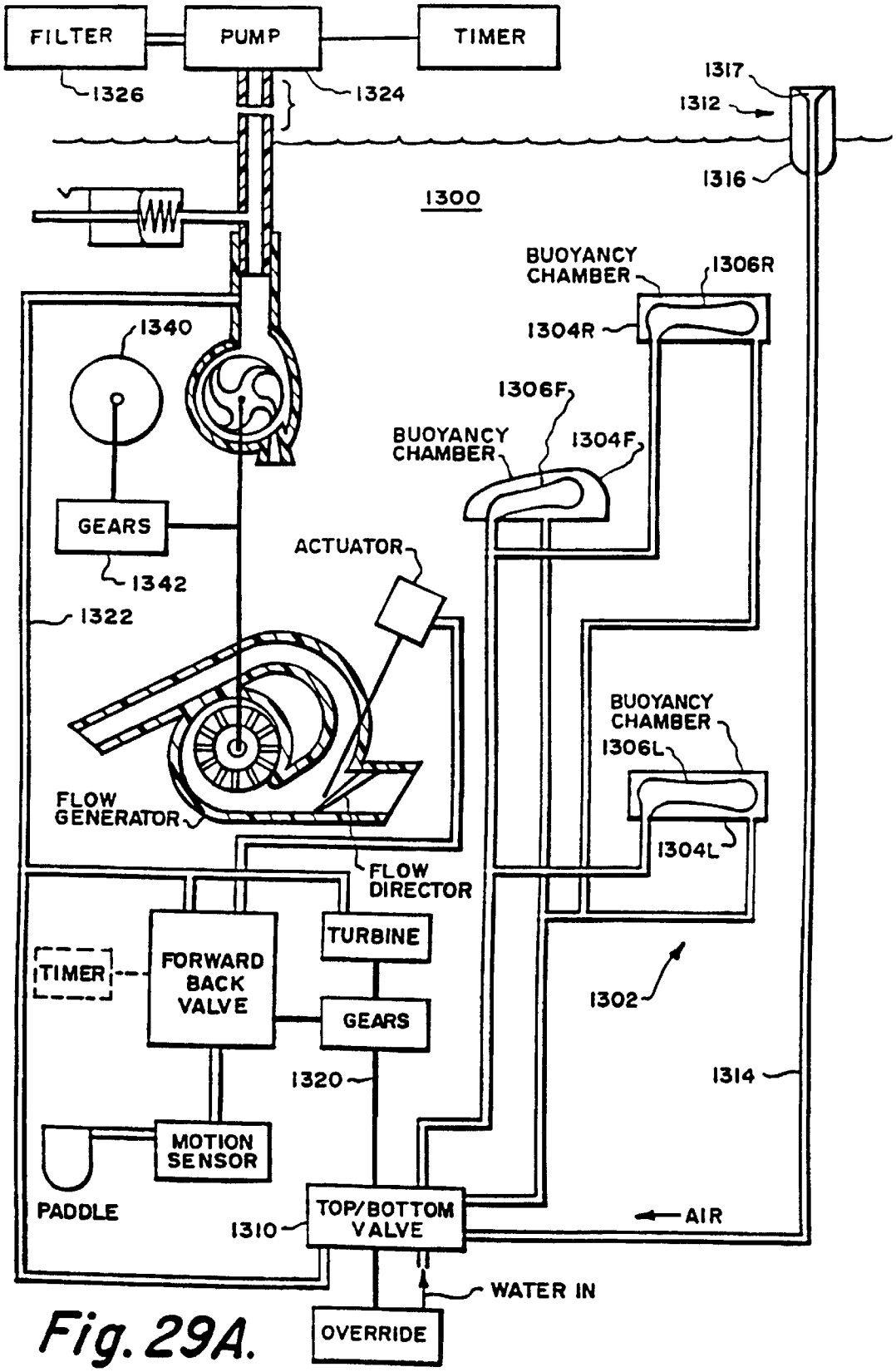
FIG. 29A is a schematic illustration depicting another alternative system.

Attention is now directed to FIG. 29A which illustrates a seventh embodiment 1300 similar to FIG. 22. However, instead of using a pitch control subsystem 1002 to modify body pitch, embodiment 1300 employs a buoyancy control subsystem 1302 which functions to (1) float the body to the water surface or (2) permit it to sink to the wall surface.

The buoyancy control subsystem 1302 is comprised of chambers 1304F, 1304R, and 1304L which respectively include flaccid bags 1306F, 1306R, and 1306L. The subsystem 1302, in conjunction with top/bottom valve assembly 1310 functions to either fill the flaccid bags with air to float the body or fill the chambers with water to permit the body to sink. Air is selectively provided to the flaccid bags 1306 via at least one snorkel 1312 coupled to the top/bottom valve 1310 via hose 1314.

More particularly, the snorkel 1312 is comprised of a buoyant head 1316 intended to float at the water surface above the cleaner body. The head includes an air inlet 1317 which permits air to be supplied to the top/bottom valve 1310 via tube 1316. The snorkel head 1316 can be implemented in different ways and, for example, can include a mechanical valve mechanism or a hydrophobic filter which passes air, but not water, down tube 1316. The tube 1316 is primarily flexible but can incorporate at least one non-flexible portion and/or swivels to minimize tangling. The tube 1316 can be structurally separate from the primary suction hose or can be integrated with it, as for example, being contained within the primary suction hose.

Figure 29B:
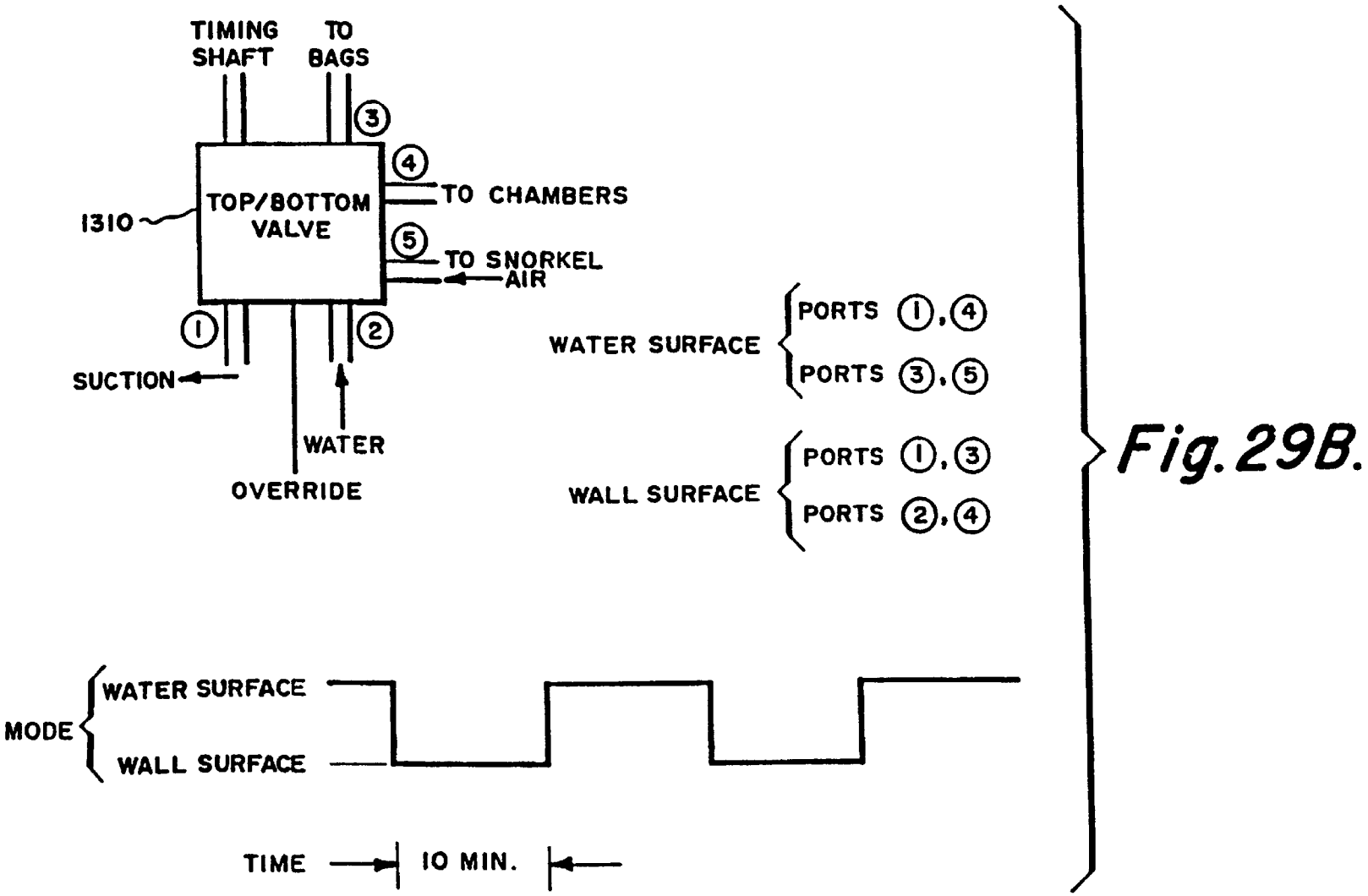
FIG. 29B is a block diagram depicting the operation of the top/bottom valve assembly of FIG. 29A.

The top/bottom valve 1310 is schematically depicted in FIG. 29B. It is similar to the top/bottom valve 1050 previously described in connection with FIG. 25B. Note that port 3 of valve 1310 is coupled directly to the flaccid bags 1306 in chambers 1304. Port 4 of valve 1310 is coupled to the interior of chambers 1304.

Valving interval to valve assembly 1310 is driven by a timing shaft 1320 and defines the water surface mode or the wall surface mode. In the water surface mode, in order to float the body to the water surface, it is necessary to fill the flaccid bags 1306 and evacuate waterfrom the chambers 1304. This action occurs by the internal valving coupling ports 1 and 4 to pull water out of the chambers and ports 3 and 5 to supply air to the bags.

In the wall surface mode, ports 1 and 3 are coupled to pull air out of the bags and ports 2 and 4 are coupled to supply water to the chambers. The air sucked by port 1 from the bags via port 3 will traverse tube 1322 and be delivered to the main pump 1324 and ultimately to the main filter 1326. The relatively small amounts of air involved are well tolerated by the filter with the air ultimately being expelled either through the pool return lines or via an automatic valve (not shown) associated with the filter.

It is further pointed out that the system of FIG. 29A shows at least one traction wheel 1340 being driven via gearing 1342, in a manner previously discussed in connection with FIG. 11A.

From the foregoing, it should now be appreciated that a method and apparatus has been disclosed herein powered from the suction or negative pressure side of a pump for cleaning the interior surface of a pool containment wall and/or the upper surface of a water pool contained therein. Apparatus in accordance with the invention includes an essentially unitary cleaner body and a level control subsystem for selectively moving the body to a position either proximate to the surface of the water pool for water surface cleaning or proximate to the interior surface of the containment wall for wall surface cleaning.

The invention can be embodied in a cleaner body having a weight/buoyancy characteristic to cause it to normally rest either (1) proximate to the pool bottom adjacent to the wall surface (i.e., heavier-than-water) or (2) proximate to the water surface (i.e., lighter-than-water). With the heavier-than-water body, the level control subsystem in an active state produces a vertical force component for lifting the body to proximate to the water surface for operation in a water surface cleaning mode. With the lighter-than-water body, the level control subsystem in an active state produces a vertical force component for causing the body to descend to the wall surface for operation in the wall surface cleaning mode.

Although the present invention has been described in detail with reference only to a few specific embodiments, those of ordinary skill in the art will readily appreciate that various modifications can be made without departing from the spirit and the scope of the invention.

What is claimed:

1. Apparatus configured to be driven by a source of negative pressure for cleaning the interior surface of a containment wall and the upper surface of a water pool contained therein, said apparatus comprising:

a body configured for immersion in said water pool;

means for coupling a negative pressure source to said body;

a level control subsystem responsive to said negative pressure source for producing a vertical force to selectively place said body either (1) in a first mode proximate to said water surface or (2) in a second mode proximate to said wall surface below said water surface;

at least one pool water inlet in said body; and a propulsion control subsystem responsive to said negative pressure source for selectively moving said body either (1) along a path adjacent to said water surface for collecting pool water through said inlet from adjacent to said water surface or (2) along a path adjacent to said wall surface for collecting pool water through said inlet from adjacent to said wall surface;

said propulsion control subsystem including a controller for selectively causing said body to move either in a forward direction or in a second direction different from said forward direction;

said controller including (1) a periodic control device for alternately defining first and second conditions and (2) a motion responsive control device for defining a first condition when the rate of forward motion of said body is greater than a certain threshold and a second condition when the rate of forward motion of said body is less than a certain threshold; and wherein said controller causes said body to move in said second direction when said periodic control device and said motion responsive control device concurrently define said respective second conditions.

2. The apparatus of claim 1 wherein said body has a weight/buoyancy characteristic biased to cause said body to normally rest proximate to said interior wall surface; and wherein said level control subsystem selectively defines an active state for producing a vertical force component for lifting said body to proximate to said water surface.

3. The apparatus of claim 2 wherein said level control subsystem in said active state discharges a water outflow from said body in a direction to produce a vertically upward force on said body to lift said body to said water surface.

4. The apparatus of claim 2 wherein said level control subsystem in said active state produces a water flow to modify said weight/buoyancy characteristic to lift said body to said water surface.

5. The apparatus of claim 1 wherein said body has a weight/buoyancy characteristic biased to cause said body to normally rest proximate to said water surface; and wherein said level control subsystem selectively defines an active state for producing a vertical force component for holding said body proximate to said wall surface.

6. The apparatus of claim 1 further including:

means for removing debris from pool water collected through said inlet.

7. The apparatus of claim 6 wherein said means for removing debris includes a water permeable debris container for retaining debris removed from water received through water inlet.

8. The apparatus of claim 1 wherein said pool water inlet comprises a wall surface inlet port; and means for creating a suction adjacent to said inlet port when said body is proximate to said wall surface for drawing in pool water from proximate to said wall surface.

9. The apparatus of claim 1 wherein said pool water inlet comprises a water surface inlet port for passing pool surface water when said body is proximate to said water surface; and a debris container carried by said body for collecting debris borne by said surface water passed through said water surface inlet port.

10. The apparatus of claim 1 wherein said propulsion control subsystem includes a direction controller for selectively defining a first state to produce a force on said body for moving said body in a first direction or a second state to produce a force on said body for moving said body in a second direction.

11. The apparatus of claim 1 further including a timing device for alternately causing said level control subsystem to define said first and second modes.

12. The apparatus of claim 1 further including a user control operable to selectively maintain said level control subsystem in either said first or said second modes.

13. The apparatus of claim 1 further including a suction indicator carried by said body for visually indicating the magnitude of negative pressure supplied to said body.

* * * * *